US010563385B1

(12) United States Patent
Ball et al.

(10) Patent No.: US 10,563,385 B1
(45) Date of Patent: Feb. 18, 2020

(54) OVERFLOW COVER INTERCONNECTION SYSTEM

(71) Applicant: WCM Industries, Inc., Colorado Springs, CO (US)

(72) Inventors: William T. Ball, Colorado Springs, CO (US); Eric Pilarczyk, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 0 days.

(21) Appl. No.: 15/597,691

(22) Filed: May 17, 2017

Related U.S. Application Data

(60) Provisional application No. 62/337,766, filed on May 17, 2016, provisional application No. 62/366,518, filed on Jul. 25, 2016, provisional application No. 62/366,982, filed on Jul. 26, 2016.

(51) Int. Cl.
*E03C 1/24* (2006.01)

(52) U.S. Cl.
CPC ..... *E03C 1/24* (2013.01)

(58) Field of Classification Search
CPC ..... E03C 1/24; E03C 1/244; E03C 2001/2413
See application file for complete search history.

(56) References Cited

U.S. PATENT DOCUMENTS

| | | | |
|---|---|---|---|
| 37,956 | A | 3/1863 | Dyott |
| 156,971 | A | 11/1874 | Beins et al. |
| 427,478 | A | 5/1890 | McEvoy |
| 437,289 | A | 9/1890 | Clark |
| 569,247 | A | 10/1896 | Smith |
| 608,207 | A | 8/1898 | Merritt |
| 775,020 | A | 11/1904 | Waterman |
| 820,437 | A | 5/1906 | Pehrson |
| 843,968 | A | 2/1907 | Sharp, Jr. |
| 880,939 | A | 3/1908 | Virgo |
| 917,717 | A | 4/1909 | Diedrick |
| 938,102 | A | 10/1909 | Wise |
| 952,240 | A | 3/1910 | Deming |
| 964,954 | A | 7/1910 | Coles |
| 1,013,175 | A | 1/1912 | Jones |

(Continued)

FOREIGN PATENT DOCUMENTS

| | | |
|---|---|---|
| CA | 530215 | 9/1956 |
| CH | 346187 | 6/1960 |

(Continued)

OTHER PUBLICATIONS

"AB&A Catalog," American Brass & Aluminum Foundry, Inc., Sep. 1, 1995, 28 pages.

(Continued)

*Primary Examiner* — Janie M Loeppke

(57) ABSTRACT

An overflow cover interconnection system utilizes an overflow elbow with an upper portion for insertion through an overflow drain hole in a bathtub wall; a nut, ring, or other component that fits on or around the upper portion to secure the overflow elbow in position; and an overflow cap that shields the upper portion and nut, ring, or other component from view of a user of the bathtub. The system is configured for use with bathtubs having varying wall thicknesses, without necessitating any modifications thereof.

19 Claims, 18 Drawing Sheets

(56) References Cited

U.S. PATENT DOCUMENTS

| | | | |
|---|---|---|---|
| 1,018,021 | A | 2/1912 | Willetts |
| 1,068,039 | A | 7/1913 | Clark |
| 1,173,710 | A | 2/1916 | Crocker et al. |
| 1,173,854 | A | 2/1916 | Pearch |
| 1,213,466 | A | 1/1917 | Delanoy et al. |
| 1,330,909 | A | 2/1920 | Sharp, Jr. |
| 1,331,018 | A | 2/1920 | Luthy |
| 1,371,715 | A | 3/1921 | West |
| 1,518,599 | A | 12/1924 | Murray |
| 1,528,081 | A | 3/1925 | Schermerhorn et al. |
| 1,573,820 | A | 2/1926 | Gade |
| 1,645,027 | A | 10/1927 | Scott |
| 1,669,473 | A | 5/1928 | Kelso |
| 1,692,710 | A | 11/1928 | Spahn |
| 1,712,704 | A | 5/1929 | Kiser |
| 1,760,704 | A | 5/1930 | Lindstrom |
| 1,781,719 | A | 11/1930 | Darling |
| 1,788,083 | A | 1/1931 | Church |
| 1,805,816 | A | 5/1931 | Fleming |
| 1,873,274 | A | 8/1932 | Boosey |
| 1,893,979 | A | 1/1933 | Barrere |
| 1,923,482 | A | 8/1933 | Frankenstein |
| 1,925,008 | A | 8/1933 | Schacht |
| 1,977,177 | A | 10/1934 | De Flores |
| 1,980,493 | A | 11/1934 | Morrisseau |
| 2,016,498 | A | 10/1935 | Hopewell |
| 2,036,614 | A | 4/1936 | Tharp |
| 2,044,253 | A | 6/1936 | Morris |
| 2,045,731 | A | 6/1936 | Solari |
| 2,045,732 | A | 6/1936 | Solari |
| 2,059,532 | A | 11/1936 | Nagel |
| 2,061,553 | A | 11/1936 | Acosta |
| 2,062,145 | A | 11/1936 | Pickop |
| 2,084,437 | A | 6/1937 | Frankenberger |
| 2,096,651 | A | 10/1937 | Romeo |
| 2,150,483 | A | 3/1939 | Bentz |
| 2,190,532 | A | 2/1940 | Lukonski |
| 2,193,527 | A | 3/1940 | Bentz |
| 2,197,716 | A | 4/1940 | Whitaker |
| 2,222,807 | A | 11/1940 | Burr |
| 2,223,365 | A | 12/1940 | Groeniger |
| 2,278,566 | A | 4/1942 | Schaible |
| 2,323,224 | A | 6/1943 | Kuhnle |
| 2,374,815 | A | 5/1945 | Haas, Jr. |
| 2,444,340 | A | 6/1948 | Donahue |
| 2,462,752 | A | 2/1949 | Kotches |
| 2,528,919 | A | 11/1950 | Stone et al. |
| 2,570,546 | A | 9/1951 | Hamlett |
| 2,580,575 | A | 1/1952 | Muckler |
| 2,664,142 | A | 12/1953 | Scheuerman et al. |
| 2,670,029 | A | 2/1954 | Rossi |
| 2,736,577 | A | 2/1956 | Mackey |
| 2,832,081 | A | 4/1958 | Young |
| 2,890,463 | A | 6/1959 | Young |
| 2,905,951 | A | 9/1959 | Weddendorf, Jr. |
| 2,915,903 | A | 12/1959 | Digby et al. |
| 2,965,153 | A | 12/1960 | Purcell, Sr. |
| 2,966,311 | A | 12/1960 | Davis |
| 2,976,543 | A | 3/1961 | Turner et al. |
| 2,992,437 | A | 7/1961 | Nelson et al. |
| 2,993,655 | A | 7/1961 | O'Brien |
| RE25,175 | E | 5/1962 | Nelson et al. |
| 3,037,212 | A | 6/1962 | Kleinhof |
| 3,046,028 | A | 7/1962 | Nathan |
| 3,048,415 | A | 8/1962 | Shook |
| 3,082,432 | A | 3/1963 | Pearlman |
| 3,096,527 | A | 7/1963 | Eynon |
| 3,121,879 | A | 2/1964 | Young |
| 3,263,244 | A | 8/1966 | Katz |
| 3,311,391 | A | 3/1967 | Harrell |
| 3,316,562 | A | 5/1967 | Van Dyke et al. |
| 3,345,085 | A | 10/1967 | Hanes |
| 3,349,412 | A | 10/1967 | Schwartz et al. |
| 3,380,081 | A | 4/1968 | Eilertson et al. |
| 3,416,982 | A | 12/1968 | Petzetakis |
| 3,493,978 | A | 2/1970 | Hindman et al. |
| 3,501,172 | A | 3/1970 | Pickard |
| 3,528,112 | A | 9/1970 | Warnick |
| 3,579,670 | A | 5/1971 | Frank |
| 3,608,098 | A | 9/1971 | Andrisani |
| 3,615,984 | A | 10/1971 | Chase |
| 3,684,199 | A | 8/1972 | Bebinger |
| 3,724,507 | A | 4/1973 | Kleykamp et al. |
| 3,742,525 | A | 7/1973 | Oropallo |
| 3,800,339 | A | 4/1974 | Bergin |
| 3,813,708 | A | 6/1974 | Hamburg |
| 3,860,977 | A | 1/1975 | Politz |
| 3,881,201 | A | 5/1975 | Richards |
| 3,911,635 | A | 10/1975 | Traupe |
| 3,937,497 | A | 2/1976 | Studer |
| 3,982,289 | A | 9/1976 | Robbins |
| 4,059,289 | A | 11/1977 | Morris et al. |
| 4,087,127 | A | 5/1978 | Lotta |
| D248,133 | S | 6/1978 | Shames et al. |
| 4,092,745 | A | 6/1978 | Oropallo |
| 4,123,810 | A | 11/1978 | Oropallo |
| 4,127,904 | A | 12/1978 | Junker |
| 4,135,258 | A | 1/1979 | Braga et al. |
| 4,146,939 | A | 4/1979 | Izzi |
| 4,194,251 | A | 3/1980 | Pennerstorfer |
| 4,207,632 | A | 6/1980 | Savell, Jr. et al. |
| 4,232,407 | A | 11/1980 | Williams |
| 4,233,697 | A | 11/1980 | Cornwall |
| 4,238,860 | A | 12/1980 | Dixon |
| 4,240,166 | A | 12/1980 | Altman et al. |
| 4,257,892 | A | 3/1981 | Boersma |
| 4,294,370 | A | 10/1981 | Toeppen |
| 4,307,901 | A | 12/1981 | Orberg et al. |
| 4,310,933 | A | 1/1982 | Stratman |
| 4,320,540 | A | 3/1982 | Leavens |
| 4,329,744 | A | 5/1982 | Cuschera |
| 4,352,213 | A | 10/1982 | Watts |
| 4,359,788 | A | 11/1982 | Liou |
| 4,359,790 | A | 11/1982 | Chalberg |
| 4,371,991 | A | 2/1983 | Schrott |
| 4,387,914 | A | 6/1983 | Paulson et al. |
| 4,412,361 | A | 11/1983 | Cuschera |
| 4,413,384 | A | 11/1983 | Lassche |
| 4,457,030 | A | 7/1984 | Burry |
| 4,470,437 | A | 9/1984 | Rabinovich |
| 4,475,256 | A | 10/1984 | Hatala |
| 4,502,166 | A | 3/1985 | Brown, Sr. |
| 4,505,499 | A | 3/1985 | Uglow et al. |
| 4,520,515 | A | 6/1985 | Hatala |
| 4,542,642 | A | 9/1985 | Tagliarino |
| 4,553,625 | A | 11/1985 | Tsuge et al. |
| 4,571,751 | A | 2/1986 | Barlow |
| 4,574,402 | A | 3/1986 | Brown, Sr. |
| 4,574,409 | A | 3/1986 | McAffrey |
| 4,594,738 | A | 6/1986 | Gebert |
| 4,594,740 | A | 6/1986 | Tseronakis |
| 4,599,784 | A | 7/1986 | Canu, Jr. et al. |
| 4,660,860 | A | 4/1987 | Todd |
| 4,683,597 | A | 8/1987 | Taylor et al. |
| 4,692,948 | A | 9/1987 | Martin |
| 4,706,306 | A | 11/1987 | Smith |
| 4,706,482 | A | 11/1987 | Barber |
| 4,720,877 | A | 1/1988 | Watts |
| 4,722,556 | A | 2/1988 | Todd |
| 4,730,855 | A | 3/1988 | Pelletier |
| D296,816 | S | 7/1988 | Budzinski et al. |
| 4,763,510 | A | 8/1988 | Palmer |
| 4,796,926 | A | 1/1989 | Rapsilver |
| 4,799,713 | A | 1/1989 | Uglow et al. |
| 4,813,745 | A | 3/1989 | Woody |
| 4,825,477 | A | 5/1989 | Aranda |
| 4,850,617 | A | 7/1989 | Moberly |
| 4,865,353 | A | 9/1989 | Osborne |
| 4,890,967 | A | 1/1990 | Rosenbaum |
| 4,920,582 | A | 5/1990 | Alker |
| 4,936,350 | A | 6/1990 | Huber |
| 4,945,579 | A | 8/1990 | Husting |
| 4,953,235 | A | 9/1990 | Cornwall |
| 5,025,509 | A | 6/1991 | Holt et al. |

(56) References Cited

U.S. PATENT DOCUMENTS 5,076,095 A 12/1991 Erhardt
5,115,554 A 5/1992 Fell, Sr.
5,123,123 A 6/1992 Hart et al.
5,163,480 A 11/1992 Huber
5,165,118 A 11/1992 Cendrowski
5,228,153 A 7/1993 Frankel
D341,410 S 11/1993 Molinaro
5,257,648 A 11/1993 Oropallo
5,265,281 A 11/1993 McAlpine
5,267,474 A 12/1993 Ten Hoven
5,271,108 A 12/1993 Wicke
5,273,077 A 12/1993 Oropallo
5,291,619 A 3/1994 Adorjan
5,295,760 A 3/1994 Rowe
5,297,817 A 3/1994 Hodges
5,318,230 A 6/1994 Ferguson et al.
5,324,001 A 6/1994 Duke
5,330,811 A 7/1994 Buchalter
5,350,266 A 9/1994 Espey et al.
5,351,996 A 10/1994 Martin
5,363,519 A 11/1994 Husting
5,369,815 A 12/1994 Martin
5,372,715 A 12/1994 Maggard et al.
5,376,264 A 12/1994 Betancourt
5,377,361 A 1/1995 Piskula
5,417,460 A 5/1995 Lunder
5,418,983 A 5/1995 Garguillo et al.
5,442,819 A 8/1995 Penor et al.
5,495,750 A 3/1996 Dufresne
5,497,514 A 3/1996 Miller
5,497,516 A 3/1996 Irwin
5,507,501 A 4/1996 Palmer
5,509,148 A 4/1996 Steele et al.
5,535,455 A 7/1996 Liu
D373,623 S 9/1996 Mathison
5,560,052 A 10/1996 Ferguson et al.
5,581,018 A 12/1996 Allen et al.
5,590,916 A 1/1997 Liu
D381,405 S 7/1997 Waidele et al.
5,661,462 A 8/1997 Shrewsbury-Gee
5,682,620 A 11/1997 Stoltz et al.
5,692,248 A 12/1997 Ball
5,740,830 A 4/1998 Mankins
5,745,931 A 5/1998 Ball
5,758,368 A 6/1998 Ball
5,786,054 A 7/1998 Platusich et al.
5,799,986 A 9/1998 Corbett et al.
5,815,895 A 10/1998 Carlson et al.
5,819,328 A 10/1998 Lewis
5,881,397 A 3/1999 Hobbs
5,890,241 A 4/1999 Ball
5,924,635 A 7/1999 Koshimizu et al.
5,931,184 A 8/1999 Armenia et al.
5,937,450 A 8/1999 Jones
5,944,985 A 8/1999 Bowman
5,957,514 A 9/1999 Brookshire
5,971,438 A 10/1999 Johnson
5,997,049 A 12/1999 Kingsford et al.
6,058,525 A 5/2000 Paden
6,058,526 A 5/2000 Parisi et al.
6,062,254 A 5/2000 Brady et al.
6,066,119 A 5/2000 Ball
6,067,669 A 5/2000 Peterson et al.
6,070,910 A 6/2000 Hodges
6,073,278 A * 6/2000 Ball ..... E03C 1/24 4/694
D428,133 S 7/2000 Chen
6,618,875 B1 * 9/2003 Oropallo ..... E03C 1/24 4/694
6,622,317 B1 9/2003 Oropallo et al.
6,631,623 B1 10/2003 Ball
6,637,050 B1 10/2003 Ball
6,640,358 B2 11/2003 Ball
6,675,406 B2 1/2004 Ball
6,675,407 B1 1/2004 Ball
6,681,420 B1 1/2004 Ball
6,687,926 B1 2/2004 Bayley
6,691,411 B2 2/2004 Ball
6,696,943 B1 2/2004 Elrod et al.
6,719,294 B2 4/2004 Nguyen et al.
6,735,791 B1 5/2004 Lordahl et al.
6,789,275 B2 9/2004 Spells, Sr. et al.
6,795,987 B2 9/2004 Cornwall
6,799,606 B1 10/2004 Howson
6,800,024 B1 10/2004 Prevost
6,812,844 B1 11/2004 Burgess
6,823,540 B2 11/2004 Gunn
6,836,911 B2 1/2005 Minnick
6,880,179 B2 4/2005 Wang
6,895,838 B2 5/2005 Stahnke
6,901,611 B2 6/2005 McEntire et al.
6,953,049 B2 10/2005 Kowalke
D517,666 S 3/2006 Wilk, Jr. et al.
7,013,500 B1 3/2006 Lin
7,017,199 B2 3/2006 Oropallo et al.
D523,123 S 6/2006 Wilk, Jr. et al.
7,055,184 B2 6/2006 Humber
7,096,522 B2 8/2006 Hirtriter
7,127,752 B2 10/2006 Ball
7,185,529 B2 3/2007 Ball
7,188,376 B2 3/2007 Ortiz et al.
7,210,493 B1 5/2007 Wang
7,237,280 B1 7/2007 Holden, Jr. et al.
D549,805 S 8/2007 Quach
7,300,074 B1 11/2007 Paulson
7,328,953 B2 2/2008 Werschmidt
7,343,923 B2 3/2008 Foster
7,451,502 B2 11/2008 Ball
D586,433 S 2/2009 Price et al.
7,503,083 B2 3/2009 Ball
7,506,385 B2 3/2009 Werschmidt
7,549,702 B2 6/2009 Meyers
D599,447 S 9/2009 Cummings et al.
7,740,197 B1 6/2010 Schulz
7,774,871 B1 8/2010 Arsenault
7,814,580 B2 10/2010 Coronado et al.
D627,862 S 11/2010 Ball
D627,863 S 11/2010 Ball
7,856,677 B1 12/2010 Harris
D636,468 S 4/2011 Ball
D637,696 S 5/2011 Ball et al.
7,963,568 B2 6/2011 Jensen
8,028,357 B2 10/2011 Ball
D652,122 S 1/2012 Bonhag et al.
D659,809 S 5/2012 Smith
8,166,584 B2 5/2012 Ball
D665,062 S 8/2012 Ball
8,266,735 B2 9/2012 McLeod
8,302,220 B2 11/2012 Ball
8,321,970 B2 12/2012 Ball
D674,883 S 1/2013 Ball
8,347,906 B1 1/2013 Ismert et al.
8,505,132 B2 8/2013 Ball
8,584,272 B2 11/2013 Ball
8,607,376 B2 12/2013 Ball
D705,402 S 5/2014 Yu
8,756,724 B1 * 6/2014 Lordahl ..... E03C 1/244 4/680
8,769,736 B2 7/2014 Ball
8,925,123 B2 1/2015 DeGooyer et al.
9,015,870 B2 4/2015 Ball
9,015,876 B2 4/2015 Ball
D729,257 S 5/2015 Ball
9,045,886 B2 6/2015 Ball
9,074,358 B2 7/2015 Ball et al.
9,157,220 B2 10/2015 Ball
9,200,436 B2 12/2015 Ball
9,267,274 B2 2/2016 Ball
9,663,930 B2 5/2017 Ball
10,017,925 B1 7/2018 Kuo
2001/0002494 A1 6/2001 Fritz et al.
2002/0023294 A1 2/2002 Spells, Sr.
2002/0032926 A1 3/2002 Lewis
2002/0112285 A1 8/2002 Minnick

(56) References Cited

U.S. PATENT DOCUMENTS

| | | | |
|---|---|---|---|
| 2002/0121982 | A1 | 9/2002 | Ferris et al. |
| 2003/0000012 | A1 | 1/2003 | Ball |
| 2003/0024568 | A1 | 2/2003 | Bowman |
| 2003/0025275 | A1 | 2/2003 | Miller |
| 2003/0051343 | A1 | 3/2003 | Ball |
| 2003/0151281 | A1 | 8/2003 | Williams |
| 2003/0182721 | A1 | 10/2003 | Li |
| 2003/0192115 | A1 | 10/2003 | Oropallo et al. |
| 2004/0012197 | A1 | 1/2004 | Guillaud et al. |
| 2004/0034926 | A1 | 2/2004 | Ball |
| 2004/0055083 | A1 | 3/2004 | Ball |
| 2004/0055084 | A1 | 3/2004 | Ball |
| 2004/0068792 | A1 | 4/2004 | Ball |
| 2004/0068793 | A1 | 4/2004 | Ball |
| 2004/0103474 | A1 | 6/2004 | Ball |
| 2004/0111797 | A1 | 6/2004 | Ball |
| 2004/0117907 | A1 | 6/2004 | Ball |
| 2004/0128757 | A1 | 7/2004 | Ball |
| 2004/0163165 | A1 | 8/2004 | Ortiz et al. |
| 2005/0022300 | A1 | 2/2005 | McEntire et al. |
| 2005/0035558 | A1 | 2/2005 | Dipzinski et al. |
| 2005/0050623 | A1 | 3/2005 | Greene |
| 2005/0108814 | A1 | 5/2005 | Thompson |
| 2006/0085907 | A1 | 4/2006 | Ball |
| 2006/0096018 | A1 | 5/2006 | Ball |
| 2006/0096019 | A1 | 5/2006 | Ball |
| 2006/0170208 | A1 | 8/2006 | Arning et al. |
| 2006/0218992 | A1 | 10/2006 | Ball |
| 2006/0283792 | A1 | 12/2006 | McCallum |
| 2007/0007763 | A1 | 1/2007 | Deaton |
| 2007/0039098 | A1 | 2/2007 | Ball |
| 2007/0044218 | A1 | 3/2007 | Ball |
| 2007/0044230 | A1 | 3/2007 | Ball |
| 2007/0130689 | A1 | 6/2007 | Condon et al. |
| 2008/0028514 | A1 | 2/2008 | Lock et al. |
| 2008/0047060 | A1 | 2/2008 | Ball |
| 2008/0098504 | A1 | 5/2008 | Knox et al. |
| 2008/0098517 | A1 | 5/2008 | Ball |
| 2008/0148469 | A1 | 6/2008 | Dipzinski et al. |
| 2008/0148477 | A1 | 6/2008 | Shafik |
| 2008/0155745 | A1 | 7/2008 | Burr |
| 2008/0196161 | A1 | 8/2008 | Ball |
| 2008/0235866 | A1 | 10/2008 | Ball |
| 2009/0119826 | A1 | 5/2009 | Coronado |
| 2009/0172877 | A1 | 7/2009 | Ball |
| 2009/0173396 | A1 | 7/2009 | Spadavecchia |
| 2009/0250120 | A1 | 10/2009 | Robbins |
| 2009/0260154 | A1 | 10/2009 | Shoop et al. |
| 2009/0261579 | A1 | 10/2009 | Spears |
| 2010/0037392 | A1 | 2/2010 | Ball et al. |
| 2010/0163131 | A1 | 7/2010 | Fehr et al. |
| 2011/0035867 | A1 | 2/2011 | Coronado et al. |
| 2011/0154566 | A1 | 6/2011 | Shafik |
| 2011/0173747 | A1 | 7/2011 | Evans et al. |
| 2011/0209279 | A1 | 9/2011 | Ball |
| 2011/0289667 | A1 | 12/2011 | Oropallo et al. |
| 2012/0005824 | A1 | 1/2012 | Ball |
| 2012/0048070 | A1 | 3/2012 | Richter |
| 2012/0079654 | A1 | 4/2012 | Ball |
| 2012/0090084 | A1 | 4/2012 | Ball |
| 2012/0204345 | A1 | 8/2012 | Ball |
| 2012/0246822 | A1 | 10/2012 | Ball |
| 2013/0031720 | A1 | 2/2013 | Homami |
| 2013/0055494 | A1 | 3/2013 | Ball |
| 2013/0067648 | A1 | 3/2013 | Whitehead |
| 2013/0069361 | A1 | 3/2013 | Cai et al. |
| 2013/0180045 | A1 | 7/2013 | Ball et al. |
| 2013/0191988 | A1 | 8/2013 | Ball |
| 2013/0193042 | A1 | 8/2013 | Hull |
| 2013/0269100 | A1 | 10/2013 | Ball et al. |
| 2013/0283523 | A1 | 10/2013 | Ball |
| 2013/0340163 | A1 | 12/2013 | Ball et al. |
| 2014/0101834 | A1 | 4/2014 | Ball |
| 2014/0138297 | A1 | 5/2014 | Hull |
| 2015/0089736 | A1 | 4/2015 | Bird |
| 2015/0121617 | A1 | 5/2015 | Ball |
| 2015/0152627 | A1 | 6/2015 | Ball |
| 2015/0233103 | A1 | 8/2015 | Ball |
| 2015/0275487 | A1 | 10/2015 | Ball |
| 2017/0247867 | A1 | 8/2017 | Ball |
| 2017/0356174 | A1 | 12/2017 | Humber et al. |
| 2018/0044899 | A1 | 2/2018 | Ball et al. |

FOREIGN PATENT DOCUMENTS

| | | |
|---|---|---|
| DE | 419477 | 9/1925 |
| DE | 1163257 | 3/1964 |
| DE | 1784266 | 10/1971 |
| DE | 3138912 | 4/1983 |
| DE | 3621715 | 1/1988 |
| DE | 9200488 | 3/1992 |
| DE | 4206903 | 9/1993 |
| DE | 3603877 | 1/1997 |
| DE | 20118252 | 3/2003 |
| EP | 0845559 | 6/1998 |
| FR | 744099 | 4/1933 |
| FR | 1191141 | 10/1959 |
| FR | 2643097 | 8/1990 |
| GB | 1216208 | 12/1970 |
| GB | 1216285 | 12/1970 |
| GB | 2263060 | 7/1993 |
| GB | 2338184 | 12/1999 |
| JP | S53-58752 | 5/1978 |
| JP | H02-144074 | 12/1990 |
| JP | H05-15887 | 3/1993 |
| JP | H05-88393 | 12/1993 |
| JP | H09-108130 | 4/1997 |
| JP | 2000-513421 | 10/2000 |
| JP | 2003-313913 | 11/2003 |
| WO | WO 1999/24738 | 5/1999 |
| WO | WO 99/54560 | 10/1999 |
| WO | WO 02/063109 | 8/2002 |
| WO | WO 2004/074587 | 9/2004 |
| WO | WO 2009/063334 | 5/2009 |
| WO | WO 2013/112560 | 8/2013 |

OTHER PUBLICATIONS

"Geberit Installation Manual," Geberit, Dec. 12, 2012, 10 pages.

"New WATCO Eliminator Bath Waste", WATCO, as early as Aug. 8, 2001, pp. 1-2.

"OATEYSCS Supply Chain Services Catalog," Oatey Co., 2012, 334 pages.

"PRESS-IN" Trim Kit, AB&A™ IPS Corporation (date unknown) 2 pages.

"Push N' Repair Closet Flange," IPS Corporation, 2011, [retrieved Sep. 6, 2014], 1 page. Retrieved from: http://web.archive.org/web/20111013024522/http://ipscorp.com/watertite/closetflanges/pushnrepair.

"PVC Scheduling 80 Fittings," Spears Manufacturing Co., May 28, 1996, 2 pages.

"Tubular Plastic-Innovator® 590", Woodford Manufacturing Company, first sold Aug. 16, 2001, pp. 1-2.

"Ultralite®—Type NM (Liquidtight Flexible Nonmetallic Conduit)", Southwire Company brochure/pamphlet, as early as 2003, printed on Dec. 14, 2008, pp. 1-3.

"WCM Industries—Freezeless Faucets, Yard Hydrants and Bath Wastes", as early as Aug. 2000, available at http://www.woodfordmfg.com/, printed on Sep. 15, 2005, p. 1.

"Why choose a Geberit Cable Driven Bath Waste Overflow?" Geberit, date unknown, 2 pages.

Answer and Counterclaim, *WCM Industries, Inc.* v. *IPS Corporation, et al.*, U.S. District Court, Western District of Tennessee, Western Division, Case No. 2:13-cv-02019-JPM-tmp, filed Feb. 19, 2013, 16 pages.

Canadian Examiner's Report for Application No. 2,556,523, dated Feb. 16, 2009, 2 pages.

Canadian Notice of Allowance for Patent Application No. 2,557,022, dated Mar. 17, 2009 , 1 page.

Canadian Official Action for Patent Application No. 2,557,022, dated Nov. 28, 2008, 2 pgs.

(56) References Cited

OTHER PUBLICATIONS

Canadian Official Action for Patent Application No. 2,642,379, dated Nov. 7, 2014, 3 pages.
Complaint (with Exhibits A-J), *WCM Industries, Inc.* v. *IPS Corporation, et al.*, U.S. District Court, Western District of Tennessee, Western Division, Case No. 2:13-cv-02019-JPM-tmp, filed Jan. 9, 2013, 117 pages.
Complaint for Delaratory Relief (with Exhibits 1-7), *IPS Corporation* v. *WCM Industries, Inc.*, United States District Court for the Western District of Tennessee, Case No. 2:12-cv-02694, filed Aug. 9, 2012, 58 pages.
Declaration of Wolpert and Exhibits A-D, *WCM Industries, Inc.* v. *IPS Corporation, et al.*, U.S. District Court, Western District of Tennessee, Western Division, Case No. 2:13-cv-02019-JPM-dkv, Oct. 22, 2014, 21 pages.
Defendant WCM Industries, Inc's Answer to Complaint, Affirmative Defenses and Counterclaims Against IPS Corporation, *IPS Corporation* v. *WCM Industries, Inc.*, United States District Court for the Western District of Tennessee, Case No. 2:12-cv-02694-JPM-tmp, filed Apr. 12, 2013, 10 pages.
Definition of the term "diaphragm" found at: http://www.thefreedictionary.com/diaphragm, cited in Aug. 7, 2012 OA for U.S. Appl. No. 13/234,030.
European Extended Search Report in Application 12002970.7, dated Mar. 25, 2014, 9 pages.
Great Britain Examination and Search Report for United Kingdom Patent Application No. GB1118043.7, dated Oct. 31, 2011 6 pages.
IPS Corporation's Initial Non-Infringement Contentions (with Exhibit A), *IPS Corporation* v. *WCM Industries, Inc.*, United States District Court for the Western District of Tennessee, Case No. 2:12-cv-02694-JPM-dkv, dated Jun. 7, 2013, 5 pages.
Mexican Notice of Allowance for Patent Application No. MX/a/2008/013956, dated Nov. 16, 2011, 1 page.
Mexican Official Action (with partial English summary) for Mexican Patent Application No. MX/a/2012/002782 dated Dec. 1, 2014, 3 pages.
Mexican Official Action for Patent Application No. PA/a/2005/011301, dated Mar. 18, 2010 3 pages.
Mexican Official Action for Patent Application No. PA/a/2005/011301, dated Oct. 20, 2010, 2 pgs.
PCT International Search Report for International Patent Application No. PCT/US03/09439, dated Sep. 9, 2003, 1 page.
Plaintiff IPS Corporation's Answer to Defendant WCM Industries, Inc's Counterclaims, *IPS Corporation* v. *WCM Industries, Inc.*, United States District Court for the Western District of Tennessee, Case No. 2:12-cv-02694-JPM-tmp, filed May 3, 2013, 5 pages.
Plaintiff IPS's Final Invalidity Contentions (Exhibit A), *IPS Corporation* v. *WCM Industries, Inc.*, United States District Court for the Western District of Tennessee, Case No. 2:12-cv-02694-JPM-dkv, dated Feb. 23, 2015, 3 pages.
Plaintiff IPS's Final Invalidity Contentions (Exhibit B-1), *IPS Corporation* v. *WCM Industries, Inc.*, United States District Court for the Western District of Tennessee, Case No. 2:12-cv-02694-JPM-dkv, dated Feb. 23, 2015, 951 pages.
Plaintiff IPS's Final Invalidity Contentions (Exhibit B-2), *IPS Corporation* v. *WCM Industries, Inc.*, United States District Court for the Western District of Tennessee, Case No. 2:12-cv-02694-JPM-dkv, dated Feb. 23, 2015, 1003 pages.
Plaintiff IPS's Final Invalidity Contentions (Exhibit B-3), *IPS Corporation* v. *WCM Industries, Inc.*, United States District Court for the Western District of Tennessee, Case No. 2:12-cv-02694-JPM-dkv, dated Feb. 23, 2015, 351 pages.
Plaintiff IPS's Final Invalidity Contentions (Exhibit B-7), *IPS Corporation* v. *WCM Industries, Inc.*, United States District Court for the Western District of Tennessee, Case No. 2:12-cv-02694-JPM-dkv, dated Feb. 23, 2015, 531 pages.
Plaintiff IPS's Final Invalidity Contentions (Exhibit B-8), *IPS Corporation* v. *WCM Industries, Inc.*, United States District Court for the Western District of Tennessee, Case No. 2:12-cv-02694-JPM-dkv, dated Feb. 23, 2015, 1219 pages.
Plaintiff IPS's Final Invalidity Contentions, *IPS Corporation* v. *WCM Industries, Inc.*, United States District Court for the Western District of Tennessee, Case No. 2:12-cv-02694-JPM-dkv, dated Feb. 23, 2015, 17 pages.
Plaintiff IPS's Initial Invalidity Contentions (with Exhibits A and B), *IPS Corporation* v. *WCM Industries, Inc.*, United States District Court for the Western District of Tennessee, Case No. 2:12-cv-02694-JPM-dkv, dated Aug. 6, 2013, 78 pages.
Reply to Defendant's Counterclaims, *WCM Industries, Inc.* v. *IPS Corporation, et al.*, U.S. District Court, Western District of Tennessee, Western Division, Case No. 2:13-cv-02019-JPM-tmp, filed Mar. 12, 2013, 4 pages.
U.S. Appl. No. 09/593,724 entitled "Method and Means for an Overflow Assembly to Bathtubs and the Like", by William T. Ball, filed Jun. 13, 2000, 14 pages.
U.S. Appl. No. 10/326,449, Office Action dated Jan. 13, 2004, 8 pages.
U.S. Appl. No. 10/326,449, Office Action dated Oct. 15, 2003, 7 pages.
U.S. Appl. No. 10/326,449, Office Action dated Jun. 4, 2003, 6 pages.
U.S. Appl. No. 10/247,247, Office Action dated Dec. 4, 2006, 9 pages.
U.S. Appl. No. 10/247,247, Office Action dated Feb. 17, 2006, 10 pages.
U.S. Appl. No. 10/247,247, Office Action dated Apr. 5, 2004, 8 pages.
U.S. Appl. No. 10/247,247, Office Action dated May 1, 2008, 7 pages.
U.S. Appl. No. 10/247,247, Office Action dated May 4, 2005, 12 pages.
U.S. Appl. No. 10/247,247, Office Action dated Jul. 19, 2006, 5 pages.
U.S. Appl. No. 10/247,247, Office Action dated Aug. 27, 2003, 10 pages.
U.S. Appl. No. 10/370,545, Notice of Allowance dated Jun. 20, 2006, 6 pages.
U.S. Appl. No. 10/370,545, Office Action dated Jan. 25, 2005, 13 pages.
U.S. Appl. No. 10/370,545, Office Action dated Jan. 26, 2004, 9 pages.
U.S. Appl. No. 10/370,545, Office Action dated Sep. 11, 2003, 12 pages.
U.S. Appl. No. 10/674,739, Office Action dated Dec. 19, 2005, 10 pages.
U.S. Appl. No. 10/674,739, Office Action dated May 18, 2004, 6 pages.
U.S. Appl. No. 10/674,739, Office Action dated May 5, 2006, 7 pages.
U.S. Appl. No. 10/674,739, Office Action dated Aug. 25, 2006, 6 pages.
U.S. Appl. No. 10/674,739, Office Action dated Sep. 30, 2005, 11 pages.
U.S. Appl. No. 10/674,862, Examiner's Answer dated May 15, 2008, 12 pgs.
U.S. Appl. No. 10/674,862, Notice of Allowance dated Aug. 24, 2006, 4 pgs.
U.S. Appl. No. 10/674,862, Office Action dated Aug. 18, 2004, 5 pgs.
U.S. Appl. No. 10/674,862, Office Action dated Dec. 21, 2006, 10 pgs.
U.S. Appl. No. 10/674,862, Office Action dated Mar. 28, 2005, 8 pgs.
U.S. Appl. No. 10/674,862, Office Action dated May 1, 2007, 10 pgs.
U.S. Appl. No. 10/674,862, Office Action dated Oct. 6, 2005, 6 pgs.
U.S. Appl. No. 10/674,862, Office Action dated Sep. 20, 2005, 6 pgs.
U.S. Appl. No. 10/674,862, Official Communication dated May 23, 2008, 2 pgs.
U.S. Appl. No. 10/721,694, Office Action dated Oct. 6, 2005, 11 pages.

(56) References Cited

OTHER PUBLICATIONS

U.S. Appl. No. 10/721,694, Office Action dated Mar. 13, 2009, 9 pages.
U.S. Appl. No. 10/721,694, Office Action dated Mar. 24, 2005, 10 pages.
U.S. Appl. No. 10/721,694, Office Action dated Mar. 27, 2007, 9 pages.
U.S. Appl. No. 10/721,694, Office Action dated Apr. 10, 2006, 9 pages.
U.S. Appl. No. 10/721,694, Office Action dated May 18, 2004, 7 pages.
U.S. Appl. No. 10/721,694, Office Action dated Jul. 23, 2004, 6 pages.
U.S. Appl. No. 10/721,694, Office Action dated Aug. 14, 2006, 6 pages.
U.S. Appl. No. 10/721,694, Office Action dated Aug. 27, 2007, 8 pages.
U.S. Appl. No. 10/732,726, Notice of Allowance dated Sep. 20, 2012, 5 pages.
U.S. Appl. No. 10/732,726, Office Action dated Apr. 15, 2010, 16 pgs.
U.S. Appl. No. 10/732,726, Office Action dated Aug. 20, 2008 (Examiner Answer to Appeal Brief), 2 pgs.
U.S. Appl. No. 10/732,726, Office Action dated Dec. 9, 2008, 12 pgs.
U.S. Appl. No. 10/732,726, Office Action dated Jan. 30, 2008 (Examiner Answer to Appeal Brief), 8 pgs.
U.S. Appl. No. 10/732,726, Office Action dated Jun. 2, 2008 (Examiner Answer to Appeal Brief), 2 pgs.
U.S. Appl. No. 10/732,726, Office Action dated Mar. 28, 2005 (Restriction Requirement), 4 pgs.
U.S. Appl. No. 10/732,726, Office Action dated May 1, 2008, 2 pgs.
U.S. Appl. No. 10/732,726, Office Action dated May 19, 2006 (Examiner Answer to Appeal Brief), 9 pgs.
U.S. Appl. No. 10/732,726, Office Action dated May 23, 2005, 10 pgs.
U.S. Appl. No. 10/732,726, Office Action dated May 9, 2011 9 pages.
U.S. Appl. No. 10/732,726, Office Action dated Nov. 16, 2011 9 pages.
U.S. Appl. No. 10/732,726, Office Action dated Nov. 17, 2008 (Dismissal of Appeal), 3 pgs.
U.S. Appl. No. 10/732,726, Office Action dated Oct. 24, 2005, 11 pgs.
U.S. Appl. No. 10/732,726, Office Action dated Oct. 25, 2010, 12 pgs.
U.S. Appl. No. 10/732,726, Office Action dated Sep. 4, 2009, 11 pgs.
U.S. Appl. No. 10/732,726, Office Action dated Sep. 4, 2012, 5 pages.
U.S. Appl. No. 10/738,765, Office Action dated Apr. 13, 2006, 2 pgs.
U.S. Appl. No. 10/738,765, Office Action dated Jan. 13, 2006, 8 pgs.
U.S. Appl. No. 10/738,765, Office Action dated Jun. 6, 2005, 9 pgs.
U.S. Appl. No. 10/738,765, Office Action dated May 22, 2007, 6 pgs.
U.S. Appl. No. 10/738,772, Advisory Action dated May 11, 2006, 3 pgs.
U.S. Appl. No. 10/738,772, Advisory Action dated May 13, 2005, 3 pgs.
U.S. Appl. No. 10/738,772, Notice of Allowance dated Aug. 1, 2006, 5 pages.
U.S. Appl. No. 10/738,772, Notice of Allowance dated Aug. 21, 2006, 1 page.
U.S. Appl. No. 10/738,772, Notice of Allowance dated May 11, 2006, 3 pgs.
U.S. Appl. No. 10/738,772, Notice of Allowance dated Sep. 17, 2004, 8 pgs.
U.S. Appl. No. 10/738,772, Office Action dated May 13, 2005, 3 pgs.
U.S. Appl. No. 10/738,772, Office Action dated Aug. 2, 2005, 9 pgs.
U.S. Appl. No. 10/738,772, Office Action dated Mar. 11, 2005, 10 pgs.
U.S. Appl. No. 10/738,772, Office Action dated Mar. 27, 2006, 6 pgs.
U.S. Appl. No. 10/738,772, Office Action dated Sep. 17, 2004, 9 pgs.
U.S. Appl. No. 10/971,895, Office Action dated Apr. 25, 2007, 8 pgs.
U.S. Appl. No. 10/971,895, Office Action dated Oct. 12, 2007, 9 pgs.
U.S. Appl. No. 11/161,930, Notice of Allowance dated Sep. 15, 2008, 6 pgs.
U.S. Appl. No. 11/161,930, Office Action dated Feb. 20, 2008, 6 pages.
U.S. Appl. No. 11/161,933, Notice of Allowance dated Jan. 29, 2009, 6 pgs.
U.S. Appl. No. 11/161,933, Office Action dated Jun. 23, 2008, 7 pgs.
U.S. Appl. No. 11/423,996, Office Action dated Dec. 5, 2006, 9 pages.
U.S. Appl. No. 11/423,996, Office Action dated Apr. 16, 2007, 13 pages.
U.S. Appl. No. 11/423,996, Office Action dated Jul. 7, 2006, 9 pages.
U.S. Appl. No. 11/873,200 entitled "Shower Station Testing Assembly for Pressure Testing Plumbing", by William T. Ball, filed Oct. 16, 2007, 24 pages.
U.S. Appl. No. 11/931,681, Notice of Allowance dated Aug. 4, 2011 8 pages.
U.S. Appl. No. 11/931,681, Office Action dated Apr. 26, 2011 15 pages.
U.S. Appl. No. 12/057,660, Notice of Allowance for dated Mar. 7, 2012 5 pages.
U.S. Appl. No. 12/057,660, Office Action dated Nov. 3, 2011 9 pages.
U.S. Appl. No. 12/100,762, Office Action dated Jan. 31, 2014, 10 pages.
U.S. Appl. No. 12/100,762, Office Action dated Feb. 1, 2012, 9 pages.
U.S. Appl. No. 12/100,762, Office Action dated Aug. 13, 2014 9 pages.
U.S. Appl. No. 12/100,762, Office Action dated Sep. 15, 2011 9 pages.
U.S. Appl. No. 12/405,956, Office Action dated Oct. 14, 2010, 8 pages.
U.S. Appl. No. 12/896,137, Notice of Allowance dated May 15, 2014, 5 pages.
U.S. Appl. No. 12/896,137, Office Action dated Feb. 24, 2014, 6 pages.
U.S. Appl. No. 12/896,137, Office Action dated Sep. 5, 2013, 10 pages.
U.S. Appl. No. 13/041,929, Notice of Allowance dated Feb. 11, 2015 7 pages.
U.S. Appl. No. 13/041,929, Notice of Allowance dated Mar. 11, 2015, 4 pages.
U.S. Appl. No. 13/041,929, Notice of Allowance dated Mar. 31, 2015 4 pages.
U.S. Appl. No. 13/041,929, Office Action dated Dec. 18, 2013 (Restriction Requirement), 6 pages.
U.S. Appl. No. 13/041,929, Office Action dated May 8, 2014 12 pages.
U.S. Appl. No. 13/234,030, Notice of Allowance dated Oct. 19, 2012 5 pages.
U.S. Appl. No. 13/234,030, Office Action dated Apr. 12, 2012, 15 pages.
U.S. Appl. No. 13/234,030, Office Action dated Aug. 7, 2012 13 pages.
U.S. Appl. No. 13/274,804, Notice of Allowance dated Apr. 23, 2014, 6 pages.
U.S. Appl. No. 13/274,804, Office Action dated Dec. 24, 2013, 10 pages.
U.S. Appl. No. 13/461,422, Notice of Allowance dated Apr. 18, 2013, 6 pages.

(56) References Cited

OTHER PUBLICATIONS

U.S. Appl. No. 13/461,422, Office Action dated Dec. 27, 2012 9 pages.
U.S. Appl. No. 13/669,417, Notice of Allowance dated Nov. 15, 2013, 5 pgs.
U.S. Appl. No. 13/669,417, Notice of Allowance dated Sep. 27, 2013, 9 pgs. 9 pages.
U.S. Appl. No. 13/669,417, Office Action dated Mar. 1, 2013, 7 pgs. 12 pages.
U.S. Appl. No. 13/691,405, Notice of Allowance dated Oct. 9, 2013, 7 pages.
U.S. Appl. No. 13/691,405, Office Action dated Aug. 14, 2013, 5 pages.
U.S. Appl. No. 13/726,840, Notice of Allowance dated Apr. 27, 2015, 7 pages.
U.S. Appl. No. 13/894,626, Notice of Allowance dated Aug. 10, 2015 5 pages.
U.S. Appl. No. 13/894,626, Notice of Allowance dated Oct. 29, 2015 4 pages.
U.S. Appl. No. 13/894,626, Office Action dated Jul. 16, 2015 7 pages.
U.S. Appl. No. 13/974,690, Notice of Allowance dated Jun. 15, 2015, 5 pages.
U.S. Appl. No. 13/974,690, Office Action dated Apr. 22, 2015, 9 pages.
U.S. Appl. No. 14/074,442, Office Action dated Oct. 7, 2015, 12 pages.
U.S. Appl. No. 14/074,442, Office Action dated Feb. 12, 2016, 13 pages.
U.S. Appl. No. 14/109,503, Notice of Allowance dated Mar. 11, 2015, 8 pages.
U.S. Appl. No. 14/109,503, Office Action dated Aug. 18, 2014, 6 pages.
U.S. Appl. No. 14/109,503, Office Action dated Dec. 29, 2014, 10 pages.
U.S. Appl. No. 14/618,594, Office Action dated Feb. 11, 2016, 14 pages.
U.S. Appl. No. 14/618,594, Office Action dated May 22, 2015, 13 pages.
U.S. Appl. No. 14/701,091, Notice of Allowance dated Oct. 29, 2015, 5 pages.
U.S. Appl. No. 14/701,091, Office Action dated Oct. 15, 2015, 8 pages.
U.S. Appl. No. 14/701,091, Office Action dated Jul. 15, 2015, 7 pages.
U.S. Appl. No. 14/710,351, Notice of Allowance dated Jan. 30, 2017, 7 pages.
U.S. Appl. No. 14/710,351, Office Action dated Dec. 16, 2016, 7 pages.
U.S. Appl. No. 15/596,582, Office Action dated Jul. 18, 2018, 7 pages.
U.S. Appl. No. 15/675,306, Office Action dated Aug. 8, 2018, 12 pages.
U.S. Appl. No. 29/360,523, Corrected Notice of Allowance mailed Mar. 16, 2011 3 pages.
U.S. Appl. No. 29/360,523, Notice of Allowability dated Jan. 11, 2011, 4 pgs.
U.S. Appl. No. 29/360,523, Office Action for dated Oct. 5, 2010, 8 pgs.
U.S. Appl. No. 29/360,523, Office Action dated Dec. 23, 2010, 6 pgs.
U.S. Appl. No. 29/360,524, Notice of Allowability dated Oct. 7, 2010, 11 pgs.
U.S. Appl. No. 29/362,288, Notice of Allowability dated Oct. 7, 2010, 8 pgs.
U.S. Appl. No. 29/378,602, Notice of Allowance dated Jun. 21, 2012 7 pages.
U.S. Appl. No. 29/378,602, Office Action dated Mar. 9, 2012 6 pages (Restriction Requirement).
U.S. Appl. No. 29/378,602, Office Action dated Mar. 27, 2012 5 pages.
U.S. Appl. No. 29/396,333, Notice of Allowance dated Nov. 5, 2012, 7 pages.
U.S. Appl. No. 29/396,333, Office Action dated Jul. 31, 2012, 6 pgs.
U.S. Appl. No. 29/396,333, Supplemental Notice of Allowance dated Dec. 6, 2012, 4 pages.
U.S. Appl. No. 29/484,008, Notice of Allowance dated Jan. 2, 2015, 9 pages.
U.S. Appl. No. 13/456,017, Notice of Allowance dated Feb. 4, 2015, 6 pgs.
U.S. Appl. No. 15/596,582, Notice of Allowance dated Feb. 4, 2019, 7 pages.
U.S. Appl. No. 15/675,306, Office Action dated Mar. 8, 2019, 14 pages.
U.S. Appl. No. 15/675,306, Notice of Allowance dated May 30, 2019, 7 pages.
U.S. Appl. No. 15/675,306, Notice of Allowance dated Jun. 19, 2019, 4 pages.

* cited by examiner

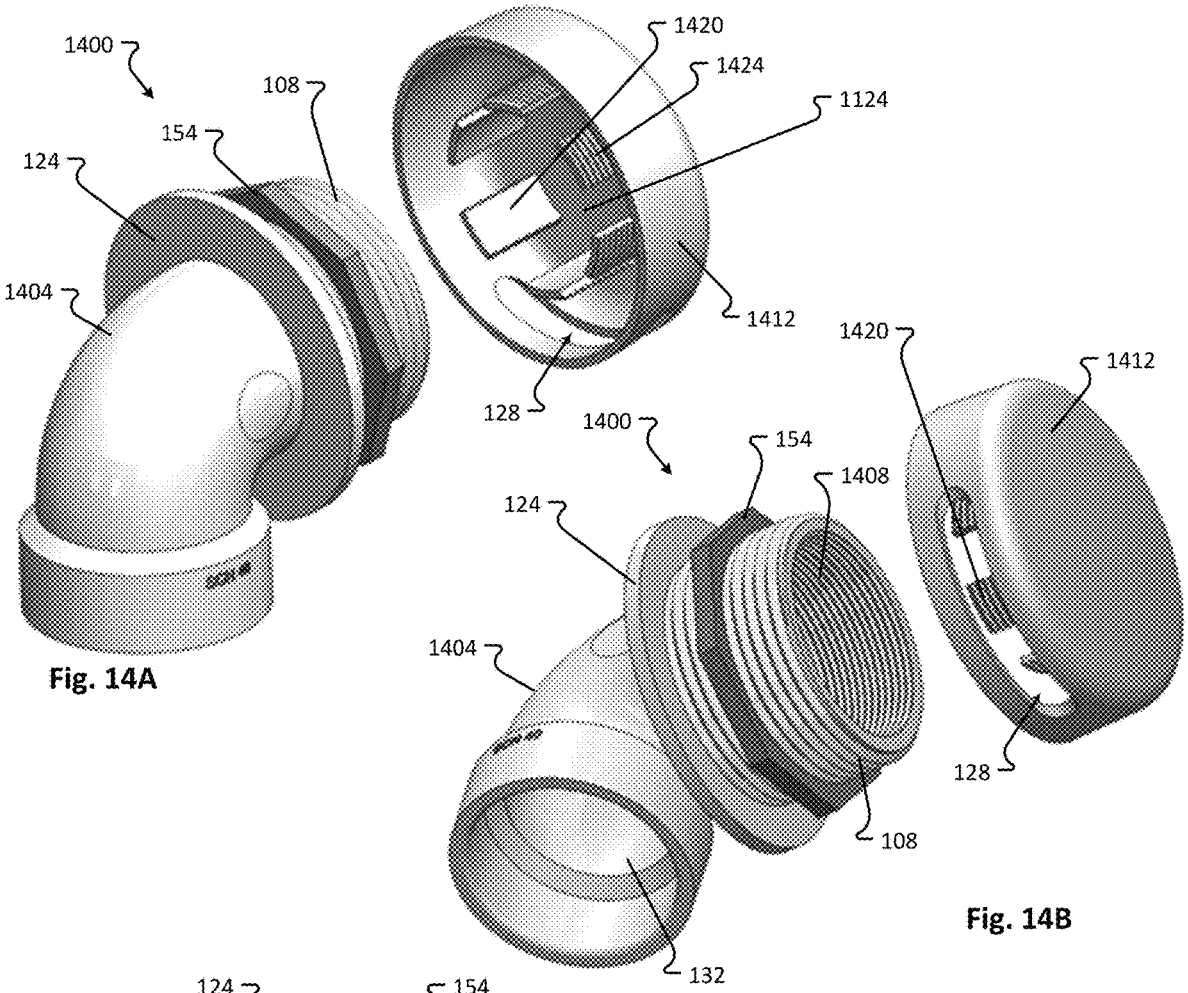
Fig. 14A
Fig. 14B
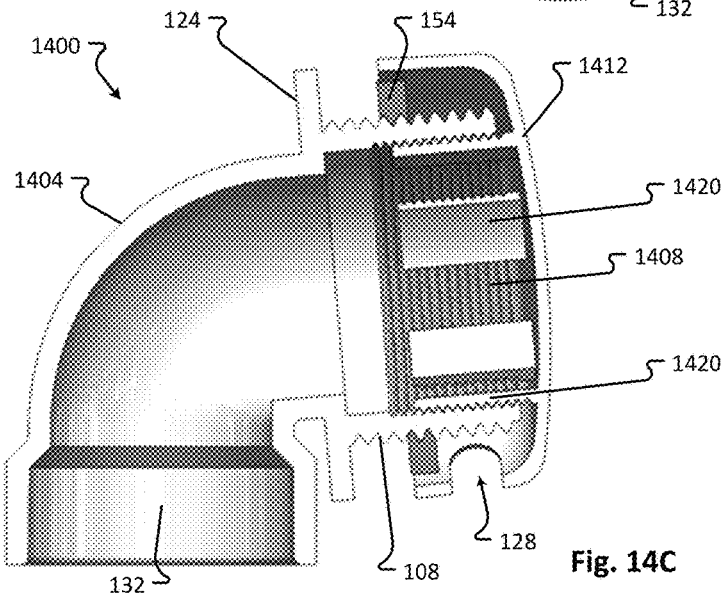
Fig. 14C

OVERFLOW COVER INTERCONNECTION SYSTEM

This application claims the benefit, under 35 U.S.C. § 119(e), of U.S. Provisional Patent Application Ser. No. 62/337,766, filed May 17, 2016; U.S. Provisional Patent Application Ser. No. 62/366,518, filed Jul. 25, 2016; and U.S. Provisional Patent Application Ser. No. 62/366,982, filed Jul. 26, 2016. The entirety of each of the foregoing applications is incorporated by reference herein.

This application is also related to U.S. Pat. Nos. 6,637,050; 6,675,406; 6,691,411; 7,503,083; 8,166,584; 8,028,357; 8,302,220; 8,321,970; 8,505,132; and 9,200,436; to U.S. Patent Application Publication Nos. U.S. 2004/0068793, U.S. 2004/0103474, U.S. 2004/0055083, and U.S. 2006/0085907; and to U.S. patent application Ser. No. 09/593,724. The entire disclosures of the foregoing issued patents, published patent applications, and patent application are incorporated by reference herein.

FIELD OF THE INVENTION

Embodiments of the present invention are generally related to bathtub overflow assemblies. More specifically, some embodiments of the present invention are directed to the interconnection of an overflow elbow to an overflow cap.

BACKGROUND OF THE INVENTION

In new building construction, plumbers prefer not to install finished closure valves in the bottom of bathtubs, and not to install finished decorative plates over an overflow outlets of bathtubs, until the project is finished, because these elements otherwise may be damaged during construction. Additionally, newly installed plumbing systems typically must be tested before use to ensure the system functions properly and does not leak. Testing typically involves closing off all inlets to the plumbing system, and filling the system with air or water and inspecting the entire system for leaks. Various means for closing off the inlets to the plumbing system are known, including inflatable balloons, screw-on stoppers, and pre-installed skins or membranes that close off plumbing inlets and can be cut away or otherwise removed before to use. When one of these fluid flow stopping mechanisms is not readily available, plumbers sometimes plug a plumbing system inlet with rags or other available materials.

Existing bathtub overflow assemblies comprise an overflow pipe positioned on the outer (dry) side of a bathtub wall, and that fits against or through an overflow hole in the bathtub wall. An overflow plate or cap is provided on the inner (wet) side of the bathtub wall to conceal the overflow drain opening and present a finished look. Common prior art overflow assemblies provided a cross beam that spans the overflow pipes opening that communicates with the bathtub interior. Alternatively, overflow pipe openings employ protrusions on opposite sides of the interior opening. To connect the cover, a central screw or two laterally opposite screws are threaded through a corresponding central hole or laterally opposite holes in the overflow cap, and into a corresponding central hole provided in the cross beam or laterally opposed holes provided in the protrusions. In these assemblies, the necessity of providing a cross-beam with a central hole across the opening of the overflow pipe, or of providing screw holes on the inner wall of the overflow pipe, adds complexity and proves inconvenient for testing purposes. The central cross-beam prevents the use of, or at least increases the difficulty of placing, an inflatable balloon with the pipe, or of stuffing the pipe with rags or other materials. The laterally opposite protrusions on the inner wall of the pipe typically change the shape of the inner circumference of the pipe, thus preventing the use of round stoppers to plug the pipe.

Additionally, both the one-hole and the two-hole style overflow assemblies often can only be installed by two persons, particular where the overflow cap is not installed until construction is complete. This is because the overflow pipe typically will not stay in position unless the overflow cap has been screwed thereto, and when construction is complete or nearly so the back side of the tub is inaccessible from the front side of the tub and vice-versa.

In other overflow assemblies, including those described in many of the references specifically identified and incorporated by reference above, a portion of the overflow pipe passes through the overflow hole in the bathtub wall, thus helping the pipe to stay in place without screws. The portion of the pipe that extends through the bathtub wall may also be threaded, such that a nut can be tightened onto the overflow pipe to secure the overflow pipe to the bathtub wall. In these assemblies, an overflow cap may be sized to snap onto, or otherwise deflectably interconnect to, the nut; thus, facilitating installation of the overflow cover once construction is complete, while also providing an aesthetically pleasing finish (e.g. by concealing the nut and overflow pipe). Also in these assemblies, leak testing may be facilitated by incorporating a membrane over the end of the overflow pipe that closes the overflow pipe. Once testing is complete, the membrane can be cut or otherwise removed to allow fluid to flow through the overflow pipe. Even where such a membrane is not provided, the inner circumference of the overflow pipe is free of any obstacles, such as a cross-beam or protrusions for accommodating screw holes, and can therefore readily receive a stopper, an inflatable balloon, or other available stopping mechanisms. Installation of an overflow cap on the overflow pipe of these no-screw overflow assemblies can be accomplished by one person, from the bathtub interior.

While no-screw overflow assemblies represent a significant improvement over the more traditional one-hole and two-hole overflow assemblies, such assemblies may still present various challengers to an installer. For example, bathtub walls have varying thicknesses, such that the upper portion of an overflow pipe (i.e. the portion that fits through the bathtub wall) must be carefully sized. If the upper portion is too long, then the overflow pipe will extend too far into the bathtub, and the overflow cap will not cover the entirety thereof. If the upper portion is too short, then it may be difficult or impossible to thread a nut onto the upper portion to secure the overflow pipe in position.

Additionally, the overflow cap and nut must be precisely sized so the overflow cap, when pressed over the nut, stays in position. Depending on the desired size of the overflow cap, this may necessitate a nut that is larger than necessary, which may disadvantageously drive up the cost of the assembly.

Further, some persons find that the overflow cap does not fit onto the cap as cleanly as they would like, or with proper alignment.

Still further, some customers, including particularly hotels and other places that offer temporary accommodations, desire a more substantial locking mechanism for retaining the overflow cap in position over the overflow pipe, to prevent theft of the overflow cap or to prevent the inadvertent dislodging of the overflow cap from its proper position.

SUMMARY OF THE INVENTION

It is one aspect of some embodiments of the present invention to provide an overflow cover interconnection system that is inexpensive to manufacture and efficient to install. It is another aspect to provide an overflow cover interconnection system that is adaptable to bathtub walls of varying thicknesses. It is yet another aspect to provide an overflow cover interconnection system that ensures proper alignment of the overflow cover with the overflow pipe. It is still another aspect of some embodiments to provide an overflow cover interconnection system that provides a more substantial locking mechanism for retaining the overflow cap in position on or over the overflow pipe.

According to one embodiment of the present invention, an overflow cover interconnection system comprises an overflow elbow comprising a lower portion and a threaded upper portion with a flange therebetween, the threaded upper portion having external threads and a first outer diameter, the lower portion and threaded upper portion defining an internal passageway; a snap ring having an outer sidewall, an inner sidewall, and a first inner diameter greater than the first outer diameter; a nut having internal threads for engaging the external threads; and a substantially cylindrical overflow cap having a closed front side, an open back side, and a cap sidewall, the cap sidewall comprising at least one aperture. The overflow cap is adapted to receive the snap ring through the open back side.

The nut may comprise a first portion adjacent a cylindrical second portion, the first portion having a plurality of alternating flats and peaks, and the cylindrical second portion having a second outer diameter less than the first inner diameter. The cylindrical second portion may be adapted to fit within the snap ring. The overflow cap may have a lip extending radially inwardly from the sidewall adjacent the back side. The outer sidewall may have a convex profile. The outer sidewall may comprise a plurality of cutouts. The snap ring may have a minimum outer diameter, and the nut may have a maximum diameter equal to or less than the minimum outer diameter. The nut may comprise a nut outer sidewall, and the nut outer sidewall may comprise a plurality of finger grips.

According to another embodiment of the present invention, an overflow cover interconnection system comprises an overflow elbow comprising a cylindrical portion with external threads; and an overflow cap having a closed face, a cylindrical sidewall, and an open back, the cylindrical sidewall comprising internal threads and at least one aperture.

The cylindrical sidewall may comprise a plurality of apertures. The overflow cap may further comprise an annular wall extending from the sidewall to the internal threads, and the internal threads may be adapted to engage the external threads. The overflow cover interconnection system may further comprise a nut, which may comprise second internal threads adapted to engage the external threads and second external threads adapted to engage the internal threads. The overflow cover interconnection system may further comprise a nut with second internal threads adapted to engage the external threads, and the internal threads of the overflow cap may also be adapted to engage the external threads. The sidewall of the overflow cap may extend past the internal threads, and the sidewall may have an internal diameter greater than an external diameter of the nut.

According to yet another embodiment of the present invention, an overflow cover interconnection system comprises an overflow elbow comprising an interior passageway and a substantially cylindrical upper portion defining an inlet to the interior passageway; and an overflow cap comprising a front surface, a substantially cylindrical sidewall, a plurality of fingers extending into a volume defined by the sidewall, and a rear opening adapted to receive at least a section of the upper portion.

The fingers may extend radially inwardly from the sidewall. The upper portion may comprise a plurality of stepped tabs on an outer surface thereof, and the stepped tabs may define a plurality of channels adapted to receive the plurality of fingers. The upper portion may comprise a plurality of branched tree tabs, and the branched tree tabs may define a plurality of channels adapted to receive the plurality of fingers. The fingers may extend rearwardly from the front face. The overflow cover interconnection system may further comprise a gasket seated in a groove in an inner wall of the substantially cylindrical upper portion of the overflow elbow; and each of the plurality of fingers may be positioned to engage the gasket when the rear opening receives at least the section of the upper portion.

Throughout this disclosure, the terms overflow plate, overflow cap, and overflow cover may be used interchangeably.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

FIG. 14A is a partially exploded perspective view of an overflow cover interconnection system according to another embodiment of the present invention;

FIG. 14B is another partially exploded perspective view of the embodiment of FIG. 14A;

FIG. 14C is a cross-sectional elevation view of the embodiment of FIG. 14A;

Figure 1A:
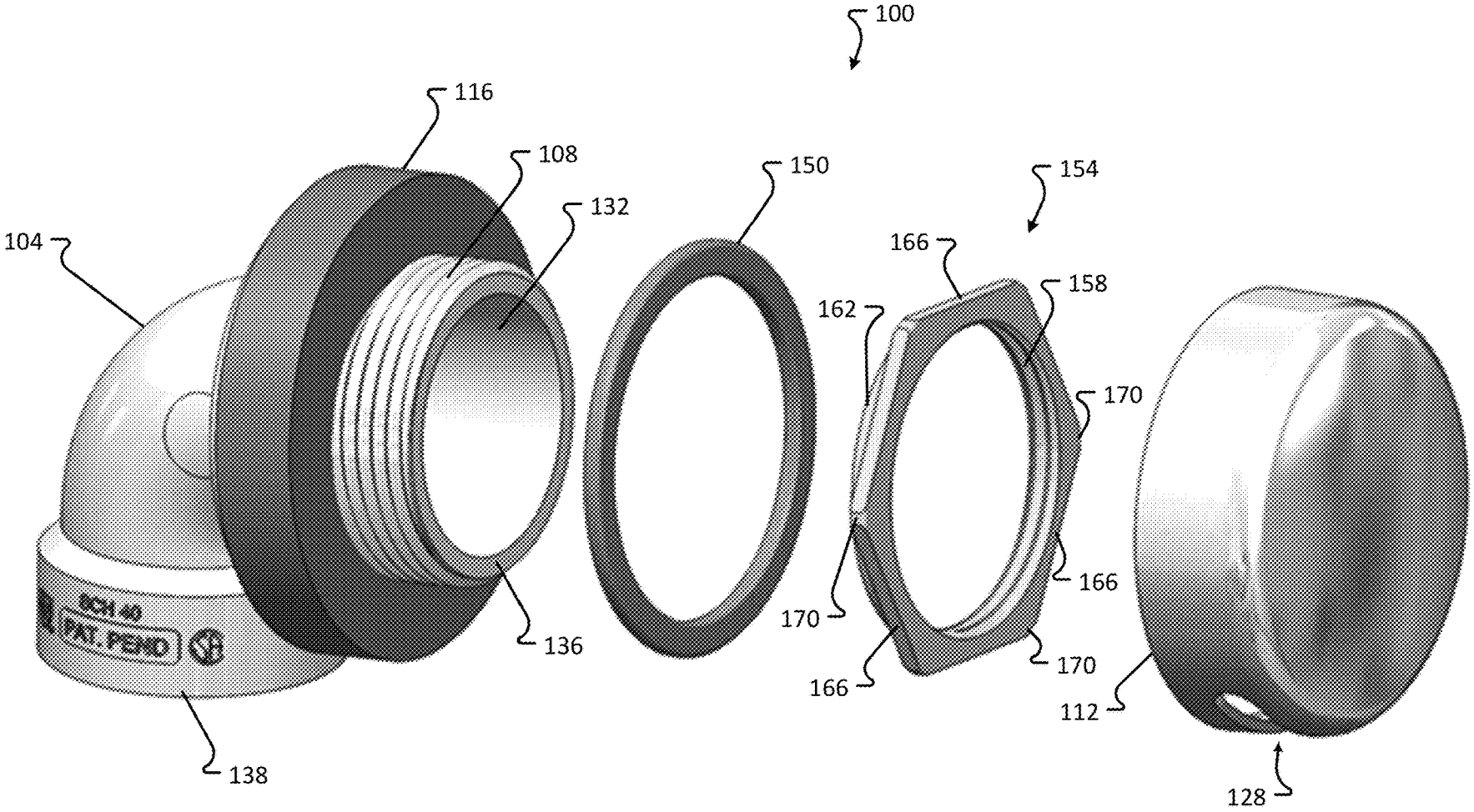
FIG. 1A is an exploded perspective view of an overflow cover interconnection system according to one embodiment of the present invention.

To assist in the understanding of one embodiment of the present invention the following list of components and associated numbering found in the drawings is provided herein:

COMPONENT

104 Overflow elbow
108 Threaded upper portion
112 Overflow cap
114 Overflow cap inner diameter lip
116 Washer
120 Tub wall
124 Elbow flange
128 Overflow aperture
132 Inner passageway
136 Front wall
138 Lower portion
140 Recessed wall
150 Snap ring
152 Snap ring incline
154 Nut
156 Snap ring decline
158 Nut threads
162 Nut extension
166 Nut flat
170 Nut peak
184 Snap ring
188 Nut
250 Snap ring
254 Nut
258 Snap ring cutouts
262 Nut cutouts
266 Snap ring outer sidewall
270 Nut outer sidewall
350 Snap ring
354 Nut
366 Snap ring outer sidewall
370 Nut outer sidewall
412 Overflow cap
416 Overflow cap threads
420 Overflow cap annular rear wall
512 Overflow cap
516 Overflow cap threads
554 Nut
558 Nut inner threads
562 Nut outer threads
612 Overflow cap
616 Overflow cap threads
620 Recessed wall

624 Overflow cap internal circumference
628 Overflow cap rear face
654 Nut
712 Overflow cap
720 Locking pin
754 Nut
758 L-shaped tab
854 Nut
858 L-shaped tab
862 Locking edge
904 Elbow
906 Stepped tab
908 Upper portion
910 Channel
912 Overflow cap
920 Extended locking pin
1004 Overflow elbow
1006 Branched tree tab
1008 Channel
1104 Overflow elbow
1108 Elbow ribs
1112 Overflow cap
1120 Inner deflectable tab
1124 Overflow cap front inside face
1212 Overflow cap
1220 Outer deflectable tab
1304 Overflow elbow
1308 O-Ring
1312 Overflow Cap
1320 Finger
1324 Groove
1404 Overflow elbow
1408 Elbow interior threads
1412 Overflow Cap
1420 Fingers
1424 Threads
1504 Overflow elbow
1508 Upper portion
1512 Overflow cap
1516 Lip
1554 Metal ring
1558 Standoff teeth
1562 Outer teeth
1566 Gripping teeth
1654 Metal ring
1712 Overflow cap
1716 Cylindrical wall with fluid openings
1750 Overflow cap
1754 Fingers
1804 Overflow elbow
1854 O-ring
1808 Inner threads
1850 Insert
1860 Insert outer threads
1864 Insert flange
1868 Insert skin
1872 Insert inner passageway It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 1C:
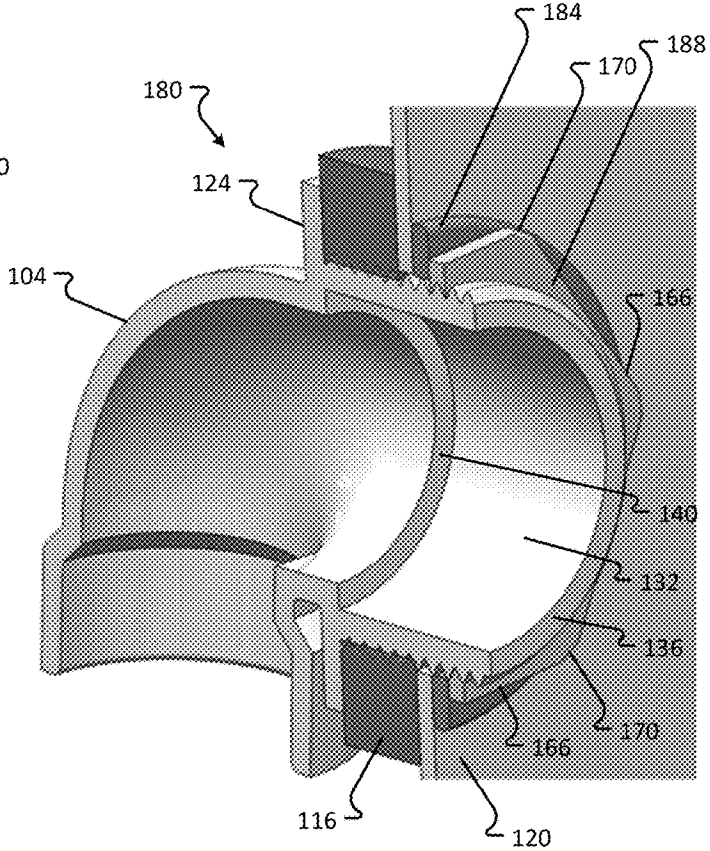
FIG. 1C is a cross-sectional perspective view of an overflow cover interconnection system according to a slight variation of the embodiment of FIG. 1A.
Figure 1B:
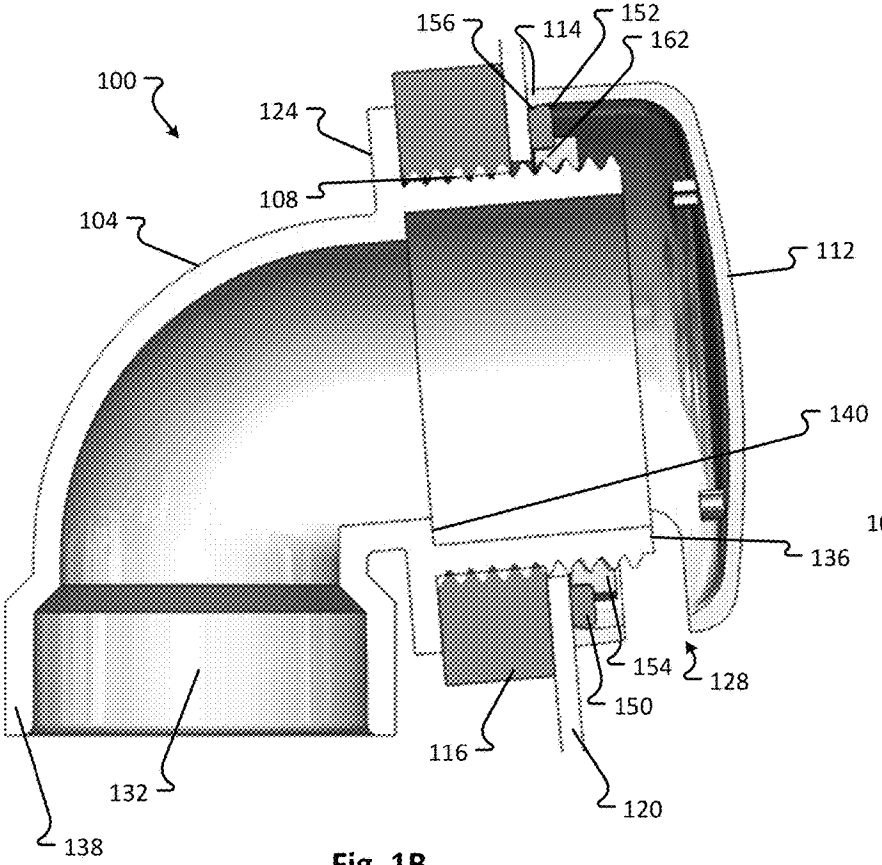
FIG. 1B is a cross-sectional elevation view of the embodiment of FIG. 1A.

FIGS. 1A and 1B show an overflow cover interconnection system 100 according to one embodiment of the present invention. The overflow cover interconnection system utilizes an overflow elbow 104, a snap ring 150, a nut 154, and an overflow cap 112. The overflow elbow 104 has a substantially cylindrical threaded upper portion 108 adapted to extend through an overflow hole in a bathtub wall 120. Water or other liquid in the bathtub can flow through the inlet defined by the front wall 136 of the elbow 104, through the inner passageway 132 of the elbow 104, thus passing the recessed wall 140 of the elbow 104, and into the other portions of the bathtub drainage system (not shown) to which the lower portion 138 of the elbow 104 is connected.

In some embodiments, an annular washer 116 may be provided to create a seal between the overflow elbow 104 and the outer side of a bathtub wall 120 in which the overflow elbow 104 is installed. Although the washer 116 is illustrated as being annular, the washer 116 may have any outside shape, provided that the washer 116 comprises a substantially circular cutout to receive the threaded upper portion 108 of the elbow 104. The thickness of the washer 116 may be selected, for example, based on the thickness of the bathtub wall 120, to ensure that the upper threaded portion 108 of the elbow 104 extends into the bathtub by a suitable amount. A flange 124 of the overflow elbow 104 presses the washer 116 against the bathtub wall 120. The threaded upper portion 108 of the overflow elbow 104 extends from the flange 124, which separates the threaded upper portion 108 from the rest of the overflow elbow 104. The washer 116 may thus help to prevent water or other liquid from leaking into the often-inaccessible area surrounding the bathtub.

The snap ring 150 of the system 100 is adapted to be held against a bathtub wall 120 (see FIG. 1B) by the nut 154, which also secures the overflow elbow 104 to the bathtub wall 120. The nut 154 may be provided with internal threads 158, and may include a first portion comprising a hexagonal (or other multi-sided) outer edge defining alternating flats 166 and peaks 170, and a second portion comprising a cylindrical nut extension 162. The hexagonal (or other multi-sided) outer edge of the first portion facilitates gripping and turning of the nut 154, whether by hand or with a tool such as a wrench or tongue-and-groove pliers, while the cylindrical nut extension 162 of the second portion is adapted to be received within the snap ring 150.

The snap ring 150, which is annular, may have an internal diameter slightly larger than an outer diameter of the nut extension 162, and, as noted above, may be adapted to fit over the nut extension 162 while being pressed against the bathtub wall 120 by the wider first portion of the nut 154 that defines the flats 166 and the peaks 170. The snap ring 150 may also have a shaped outer sidewall or edge with a convex profile. More specifically, the outer sidewall of the snap ring 150 may comprise a short, forward-facing incline 152 and a longer, backward facing decline 156 so that, when the open backside of the overflow cap 112 is pressed against the snap ring 150, the forward-facing incline 152 pushes the inner diameter lip 114 on the inner circumference of the sidewall of the overflow cap 112, adjacent the open back of the overflow cap 112, slightly outward. Eventually the lip 114 reaches the top of the incline 152 (e.g. the peak of the outer sidewall of the snap ring 150, where the snap ring 150 has a maximum diameter) and returns to its original size as it moves toward the bathtub wall 120 and along the decline 156. Once the overflow cap 112 is in place, the decline 156 of the snap ring 150 holds the lip 114 (which extends inwardly from the inner diameter of the overflow cap 112 to match the size, slope, and length of the decline 156) in position.

The overflow cap 112 may have a generally cylindrical shape, although the sidewall of the overflow cap 112 (i.e. the wall in which the aperture 128 is provided) may have a larger circumference or perimeter near the open backside or rear of the overflow cap 112 and a smaller circumference or perimeter near the closed front side or face of the overflow cap 112.

To allow the system 100 to be used on bathtubs with thicker bathtub walls 120, the snap ring 150 and the nut 154 may be manufactured with minimal thickness. Because the snap ring 150 is installed flush against the bathtub wall 120, and because the nut 154 is installed flush against the snap ring 150, the rigidity of the snap ring 150 and the nut 154 as installed is beneficially greater than the rigidity of either component standing alone, which effect may be utilized advantageously to justify or permit a reduced thickness of the snap ring 150 and the nut 154.

In the overflow cover interconnection system 100, the nut 154 has a shaped outer edge (e.g. with flats 166 and peaks 170) adapted to improve gripping by a wrench, pliers, or fingers, while the snap ring 150 contacts the overflow cap 112 substantially along the entire inner diameter of the overflow cap 112. As a result, the system 100 provides for significantly more contact area between the overflow cap 112 and the snap ring 150 than is achievable where the overflow cap 112 snaps directly onto the nut 154, as in some prior art overflow assemblies. This increased contact surface area improves retention of the overflow cap 112 by the snap ring 150. Additionally, the use of a separate snap ring 150 and nut 154 allows the outer edge or sidewall of the snap ring 150 to be shaped to facilitate the snapping of the overflow cap 112 onto the snap ring 150 (e.g. with an incline 152 and a decline 156), while allowing the nut 154 to have flat outer surfaces that are better adapted for gripping, whether with tools or by hand.

FIG. 1C depicts an overflow cover interconnection system 180 that is substantially similar to the system 100, but with two primary differences. First, the nut 188 of the system 180 has no extension 162, and is not configured to fit inside of the internal diameter of the snap ring 184. Second and relatedly, the snap ring 184 of the system 180 has an internal diameter that is smaller than the internal diameter of the snap ring 150. Rather than being sized to fit over a nut extension 162, the internal diameter of the snap ring 184 is sized to be just larger than the outer diameter of the threaded upper portion 108 of the elbow 104, so as to permit the snap ring 184 to slide over the threaded upper portion 108 until it contacts the bathtub wall 120. The nut 188 is then threaded onto the threaded upper portion 108 of the elbow 104, and holds both the elbow 104 and the snap ring 184 in position. In all other respects, the system 180 may be identical to or substantially the same as the system 100.

Figure 2:
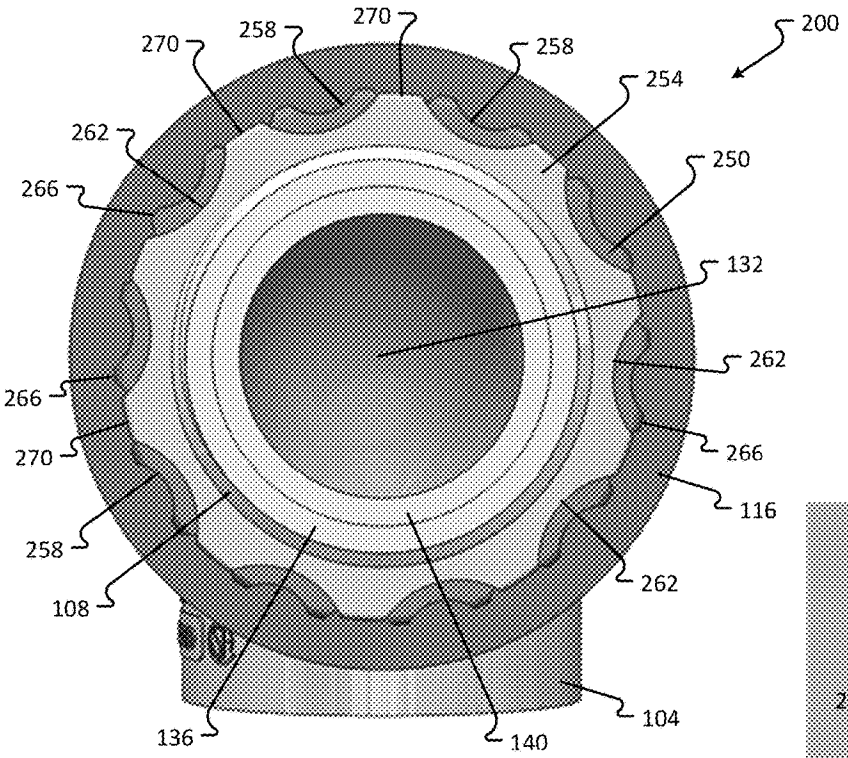
FIG. 2 is a front elevation view of an overflow cover interconnection system according to another embodiment of the present invention.

FIG. 2 depicts an overflow cover interconnection system 200 that, like the system 100, uses an elbow 104, a washer 116, a nut, and a snap ring. As described previously, the elbow 104 comprises a front wall 136, a recessed wall 140, and an inner passageway 132. The washer 116 is also substantially the same as described above. Unlike the system 100, the system 200 utilizes a nut 254 and a snap ring 250. The nut 254 differs somewhat from the nut 154 (see FIG. 1A), in that the nut 254, rather than having an outer edge that defines a plurality of alternating flats and peaks instead comprises a plurality of cutouts or finger grips 262 extending inward from the nut outer sidewall 270. Similarly, the snap ring 250 differs somewhat from the snap ring 150 (see FIG. 1A), in that rather than having an outer sidewall or edge of the snap ring 250 that defines an unbroken circle, the snap ring 250 comprises a plurality of cutouts 258 that extend inward from the snap ring outer sidewall 266. The nut cutouts 262 are adapted to facilitate the manual grasping and tightening of the nut 254 against the snap ring 250. The snap ring cutouts 258 are adapted to reduce the length of the snapping surface (e.g. the outer sidewall 266), so that less force is needed to snap the overflow cap onto the snapping ring 250. Even with the cutouts 258, the snap ring 250 still provides more contact surface with an overflow cap than would a hexagonally shaped nut 154 of FIG. 1A if the overflow cap 112 were to be snapped directly onto such a nut. The other benefits of the system 100 as described above apply as well to the system 200.

Figure 3A:
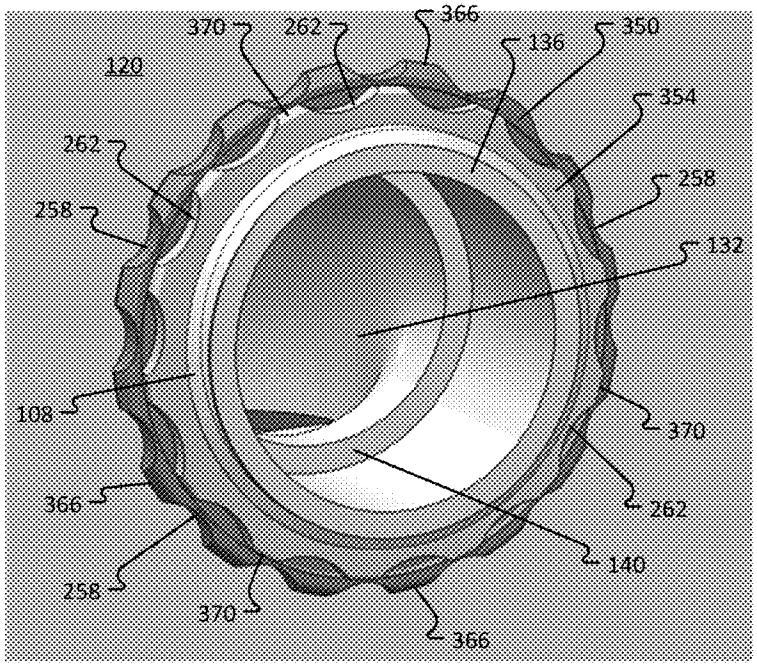
FIG. 3A is a perspective view of an overflow cover interconnection system according to another embodiment of the present invention.
Figure 3B:
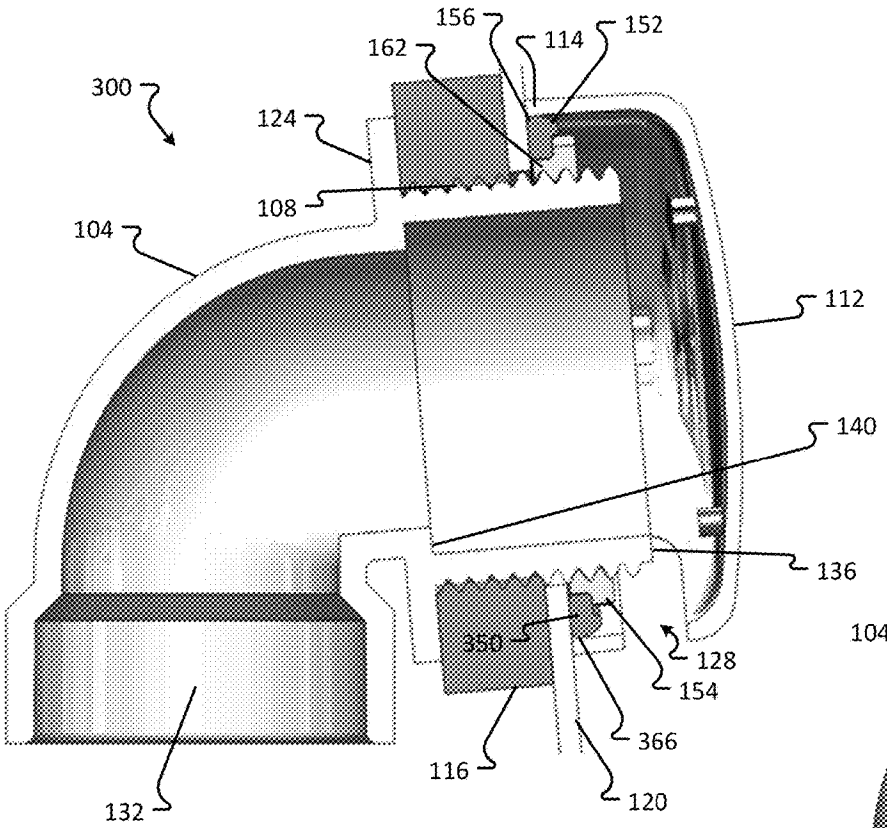
FIG. 3B is a cross-sectional elevation view of the embodiment of FIG. 3A.

With reference now to FIGS. 3A and 3B, an overflow cover interconnection system 300 is again similar to the systems 100 (FIGS. 1A-1C) and 200 (FIG. 2), with an elbow, a washer, a nut, and a snap ring. Here again, the elbow 104 comprises a front wall 136, a recessed wall 140, a flange 124, and an inner passageway 132 through which liquid may flow out of the bathtub and into a connected drainage system. The washer 116 is also the same as described above. The system 300 utilizes a nut 354 and a snap ring 350, however, that differ from the nuts and the snap rings described above. The nut 354 includes an extension 162, over which the snap ring 350 is centered for installation on the threaded upper portion 108 of the elbow 104. But the nut 354 has an outer sidewall 370 with a reduced outer diameter relative to the nut 254. Cutouts or finger grips 262 extend inwardly from the outer sidewall 370 and facilitates manual installation and tightening of the nut 354 onto the threaded upper portion 108 of the elbow 104, but the reduced diameter of the outer sidewall 370, which is approximately equal to the minimum outer diameter of the snap ring 350 (e.g. the outer diameter of the snap ring 350 between the closest points of two opposite cutouts 258), exposes more surface area of the snap ring 350. The additional exposed surface area can be used for improved snap feature geometry (e.g. to provide an improved shape of the outer sidewall 366 of the snap ring 350).

More particularly, the snap ring 350 again comprises an outer sidewall 366 with cutouts 258 extending inwardly therefrom, and again has inner diameter sized to allow the snap ring 350 to fit over the nut extension 162, but the outer sidewall 366 has a significantly more pronounced front incline 152. The inclusion of a more pronounced front incline 152 allows for a smoother, more gradual incline that facilitates installation of the overflow cap 112 onto the snap ring 350. In some embodiments, the snap ring 350 includes a shorter, less pronounced decline 156, although the lip 114 of the overflow cap 112 still matches the size, slope, and length of the decline 156. The less pronounced decline 156 facilitates removal of the overflow cap 112, while still holding the overflow cap 112 securely in position in the absence of a force being exerted on the overflow cap 112 in a direction away from the bathtub wall 120.

Figure 4:
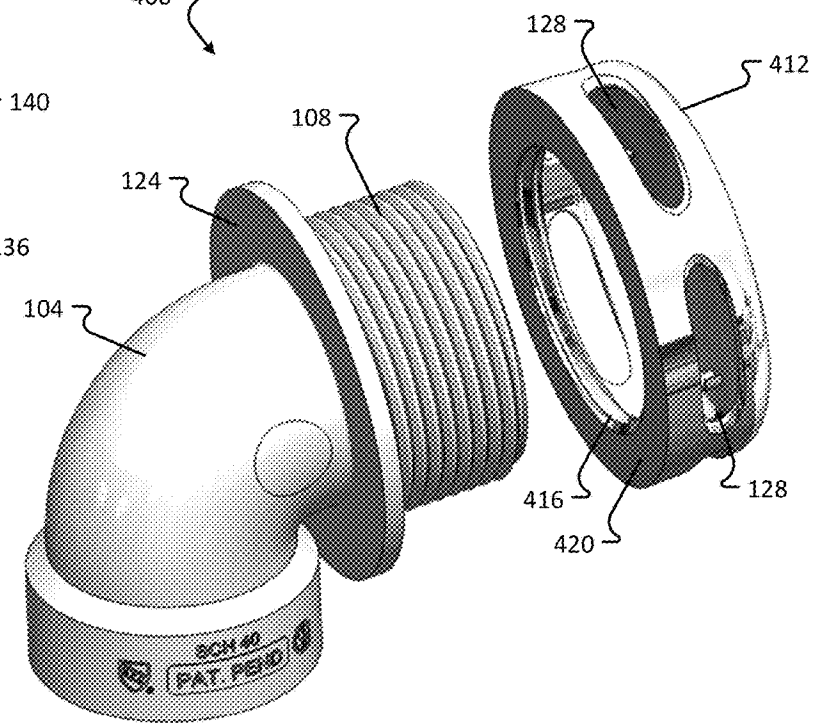
FIG. 4 is an exploded perspective view of an overflow cover interconnection system according to another embodiment of the present invention.

In an overflow cover interconnection system 400 as depicted in FIG. 4, an overflow cap 412—which, like the overflow cap 112 (e.g., FIG. 3B), is substantially cylindrical, with an open back, a closed face, and a cylindrical sidewall—is provided with internal threads 416 which can be threaded directly onto the threaded upper portion 108 of an overflow elbow 104. The internal threads 416 are provided on an inner circumference of the sidewall of the overflow cap 112, adjacent the open back thereof. The use of internal threads 416 reduces the number of parts required for the system 400, because the overflow cap 412 acts as both a nut to hold the elbow 104 in position and as an overflow cap.

Moreover, due to the placement of apertures 128 all around the sidewall of the overflow cap 412, the final orientation of the overflow cap 412 becomes largely immaterial to the aesthetics and the functionality of the system 400. Consequently, the overflow cap 412 can be threaded onto the threaded upper portion 108 until it is tight against the bathtub wall 120, without concern for the rotational orientation of the overflow cap 412 in the tightened position. The inclusion of multiple apertures 128 also facilitates the flow of water or other liquid into the overflow elbow 104, and thus may provide for a higher flow rate, making the overflow assembly as a whole better able to prevent bathtub overflow. In alternative embodiments, the overflow cap 412 may have only one aperture 128, or may have a number of apertures that is more or less than the five apertures shown in FIG. 4. Further, the upper portion 103 may possess a plurality of apertures to enhance fluid flow.

The overflow cap 412 also comprises an annular rear face or wall 420. The rear face or wall 420, which extends radially inwardly from the outer circumference of the sidewall of the overflow cap 412 to the internal threads 416, may define an annular shape. In some embodiments, the annular rear wall 420 may be in direct contact with the bathtub wall 120. In other embodiments, a washer 116 may be placed onto the threaded upper portion 108 of the elbow 104, between the bathtub wall and the overflow cap 412. In such embodiments, the washer 116 may provide a seal between the threaded upper portion 108 of the elbow 104 and the bathtub wall 120, so as to prevent water from leaking around the threaded upper portion 108 and into the (typically inaccessible) area between the bathtub and the surrounding walls. In some embodiments, for aesthetic purposes, the washer 116 may have an outer diameter that is smaller than the outer diameter of the overflow cap 412. Also in some embodiments, the annular rear wall 420 may comprise a groove or channel in which a washer 116, an O-ring, or a gasket may be placed to provide the desired seal, while remaining out of sight and, thus, avoiding an aesthetically displeasing finish.

Figure 5:
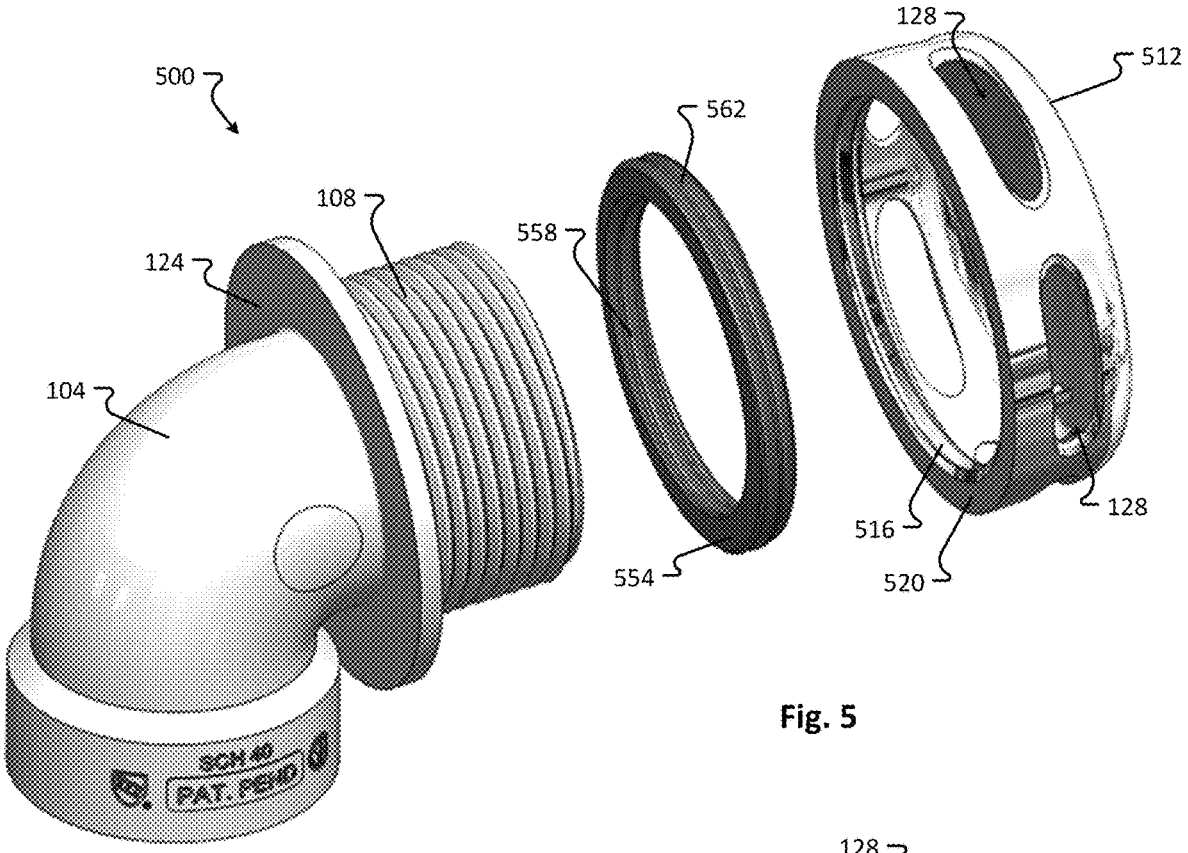
FIG. 5 is an exploded perspective view of an overflow cover interconnection system according to another embodiment of the present invention.

FIG. 5 shows an overflow cover interconnection system 500 that also uses a standard elbow 104, but does so together with a double-threaded nut 554 and a threaded overflow cap 512. The double threaded nut 554 includes inner threads 558 for engaging the outer threads of the threaded upper portion 108 of the elbow 104, and outer threads 562 onto which the inner threads 516 of the overflow cap 512 may be threaded. The nut 554 is first threaded onto the threaded upper portion 108 of the elbow 104, until the nut 554 abuts the tub wall. The overflow cap 512 is then threaded onto the outer threads 562 of the nut 554, until the annular rear wall 520 of the overflow cap 512 abuts the tub wall 120.

As with the overflow cap 412 (FIG. 4), the overflow cap 512 may be provided with any number of apertures 128.

Figure 6:
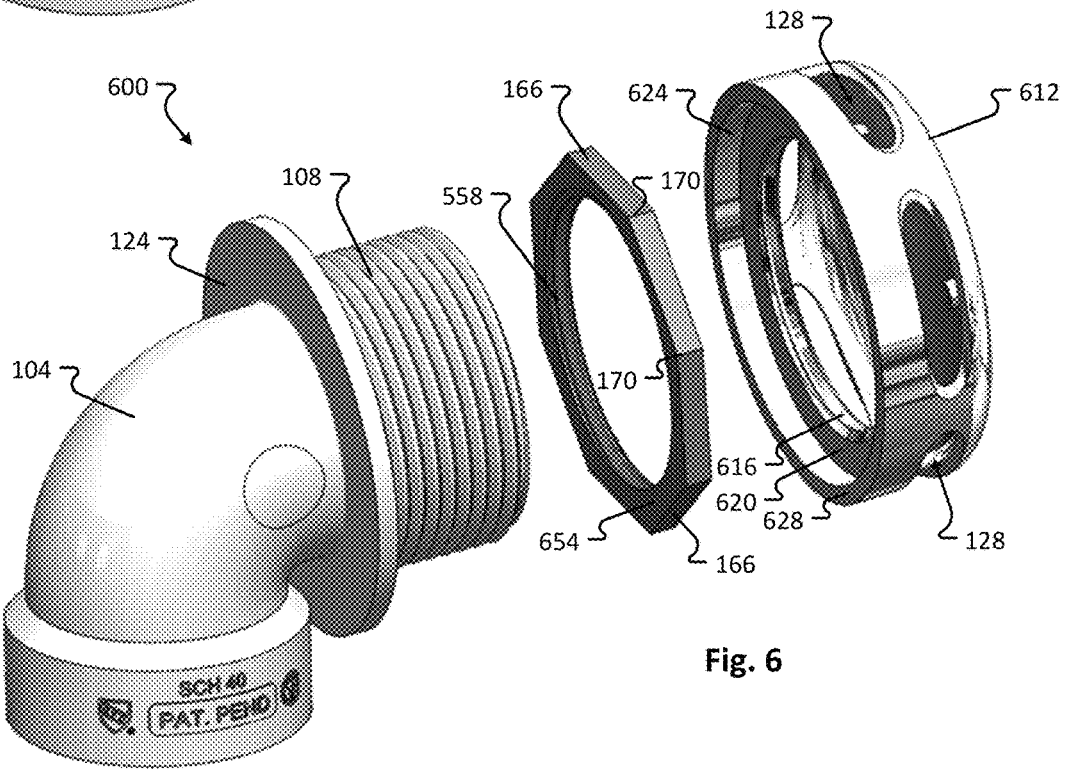
FIG. 6 is an exploded perspective view of an overflow cover interconnection system according to another embodiment of the present invention.

FIG. 6 shows a similar overflow cover interconnection system 600. In the system 600, a nut 654 comprising inner threads 558, flats 166, and peaks 170 is used to hold the elbow 104 in position. Once the nut 654 has been tightened against a bathtub wall 120, the overflow cap 612—which comprises an inner circumference 624, a recessed wall 620, and internal threads 616 provided on an inner surface of the recessed wall 620—may be threaded onto the threaded upper portion 108 until the annular rear wall 628 contacts the bathtub wall 120, or until the recessed wall 620 contacts the nut 654. Once installed, the overflow cap 612 hides the nut 654 from view, thus presenting an aesthetically pleasing finish to a user of the bathtub.

Like the overflow caps described above, the overflow cap 612 may be provided with any number of apertures 128.

Figure 7:
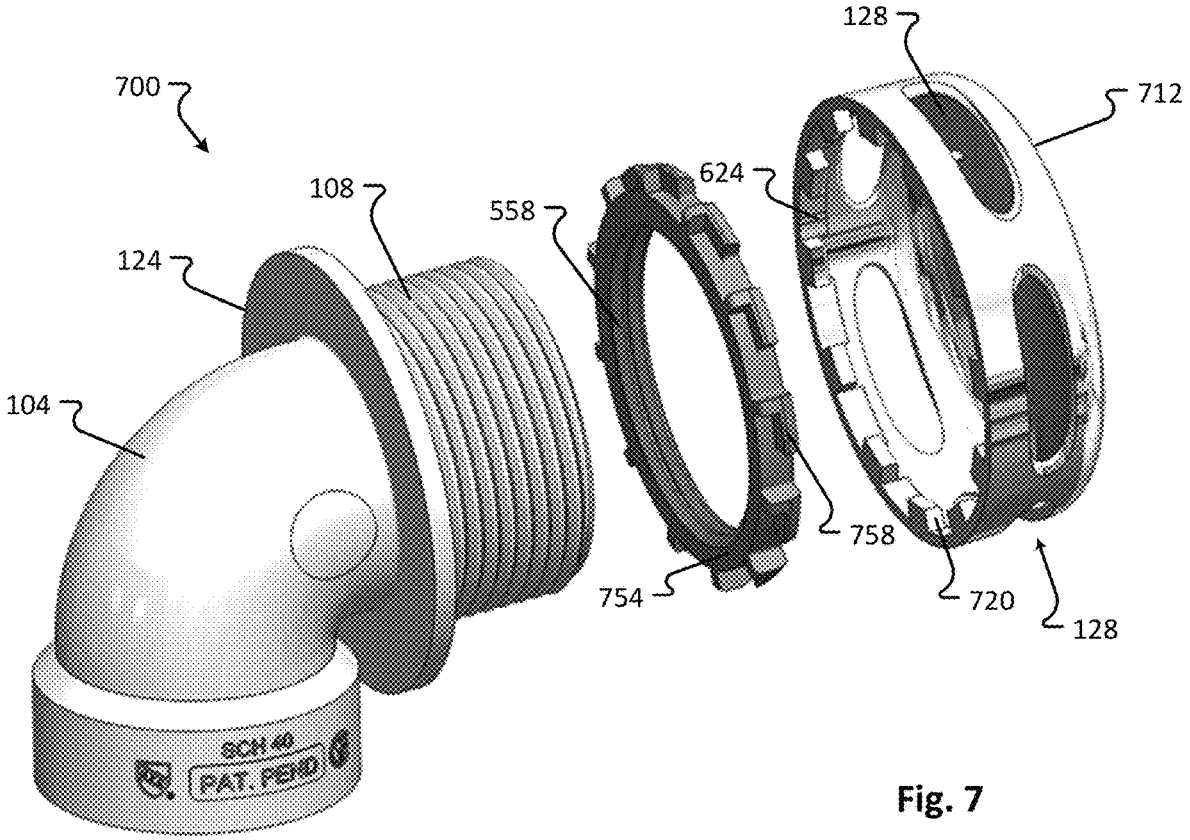
FIG. 7 is an exploded perspective view of an overflow cover interconnection system according to another embodiment of the present invention.

FIG. 7 shows an overflow cover interconnection system 700. In the system 700, a nut 754 comprises inner threads 558 and, around the outer circumference thereof, a plurality of L-shaped tabs 758. Each L-shaped tab 758 includes a first portion that runs along the front edge of the nut 754, and a second portion that runs perpendicularly from the front of edge of the nut 754 to the back edge of the nut 754, so as to intersect one end of the first portion at a right angle. The overflow cap 712 comprises a plurality of complementary locking pins 720 extending inwardly from the inner circumference 624 of the overflow cap 712.

In use, the nut 754 is threaded onto the threaded upper portion 108 of the elbow 104 until the nut 754 abuts the bathtub wall 120. The overflow cap 712 is then aligned so that the locking pins 720 are in between the tabs 758, pushed backward toward the bathtub wall 120 so that the locking pins 720 are positioned farther rearward than the first portion of the tabs 758, and rotated until the locking pins 720 are behind the first portion of the tabs 758 and abut the second portion of the tabs 758. This bayonet-style locking mechanism allows the overflow cap 712 to be securely but easily installed on the nut 754. Additionally, in embodiments where the final rotational orientation of the overflow cap 712 is important for aesthetic purposes or otherwise, the system 700 allows greater control over the final rotational orientation of the overflow cap 712.

As with the overflow caps described above, the overflow cap 712 is shown with a plurality of apertures 128, but may have more or less apertures 128 than shown.

Figure 8:
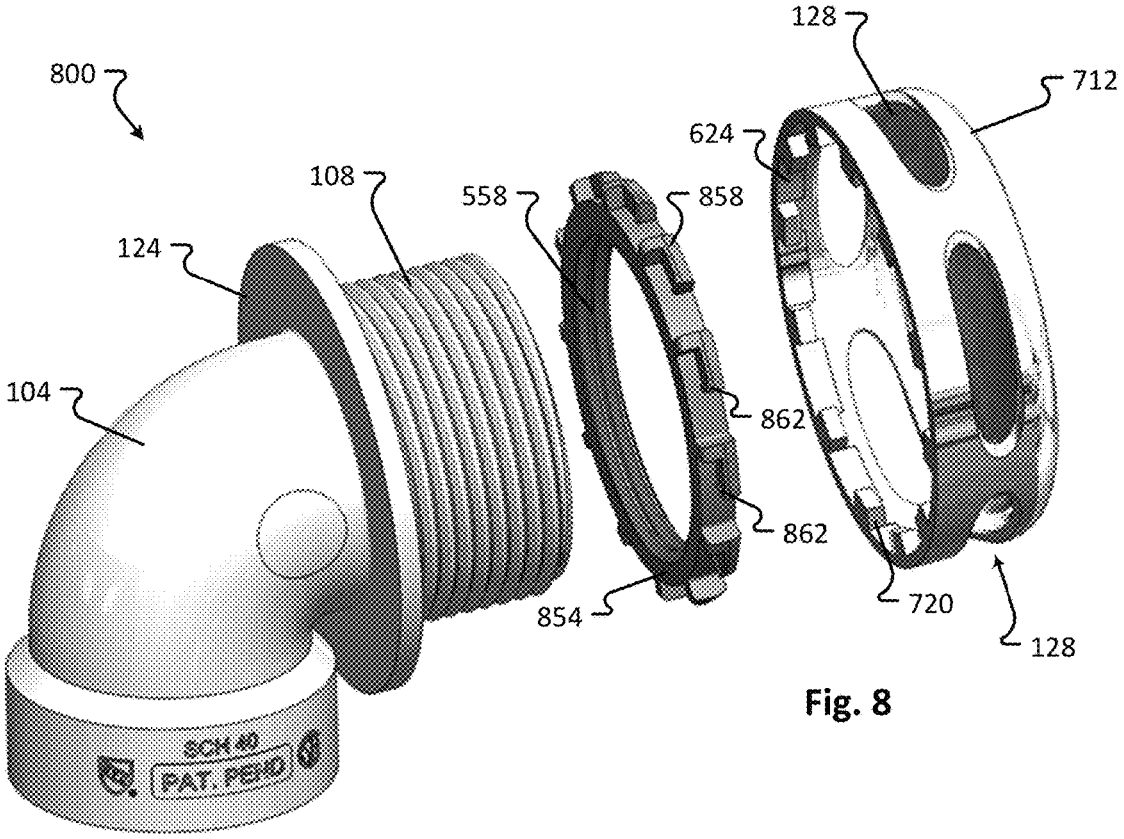
FIG. 8 is an exploded perspective view of an overflow cover interconnection system according to another embodiment of the present invention.

FIG. 8 shows an overflow cover interconnection system 800. The system 800 is substantially similar to the system 700, including in its use of a bayonet-style locking system, but the tabs 858 of the nut 854 include a locking edge 862 at the open end thereof. The locking edges 862 are located on the rear-facing side of the first portions of the tabs 858, opposite the side of the first portion from which the second portions of the tabs 858 extend, and are a small raised surface that forces the locking pins 720, the tabs 858, or both to deflect slightly when the overflow cap 712 is rotated into or out of the locked position relative to the nut 854. In some embodiments, the locking edge 862 may be a curved or double-inclined surface to facilitate rotation of the overflow cap 712 into or out of the locked position, while in other embodiments the locking edge 862 may be curved or inclined on one side (so as to facilitate rotation of the overflow cap 712 into the locked position), while having a straight surface, perpendicular to the direction of rotation, on the other side (so as to prevent rotation of the overflow cap 712 out of the locked position). In either embodiment, the locking edges 862 provide at least some resistance to rotation of the overflow cap into and/or out of the locked position, and therefore allow the overflow cap 712 of the system 800 to be locked into position more securely than is possible in the system 700.

Here again, the overflow cap 712 is shown with a plurality of apertures 128, but may have more or less apertures 128 than shown.

Notably, the embodiments described in connection with FIGS. 1A-8 all utilize a standard overflow elbow 104. Use of a standard overflow elbow 104 may advantageously reduce manufacturing costs, may allow retrofitting to existing systems, and provide other supply chain benefits. Other embodiments of the present invention, may use nonstandard overflow elbows to obtain certain advantages or features that cannot be obtained with standard overflow elbows.

Figure 9A:
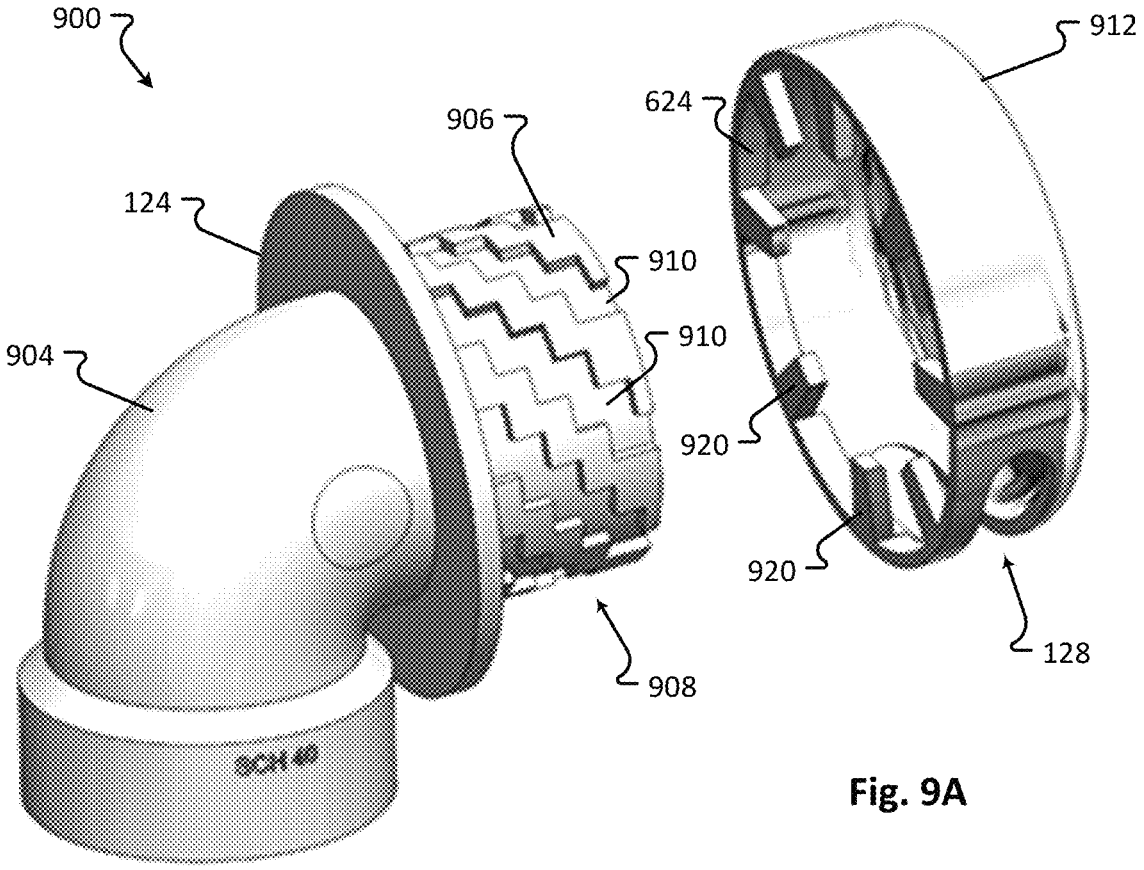
FIG. 9A is an exploded perspective view of an overflow cover interconnection system according to another embodiment of the present invention.
Figure 9B:
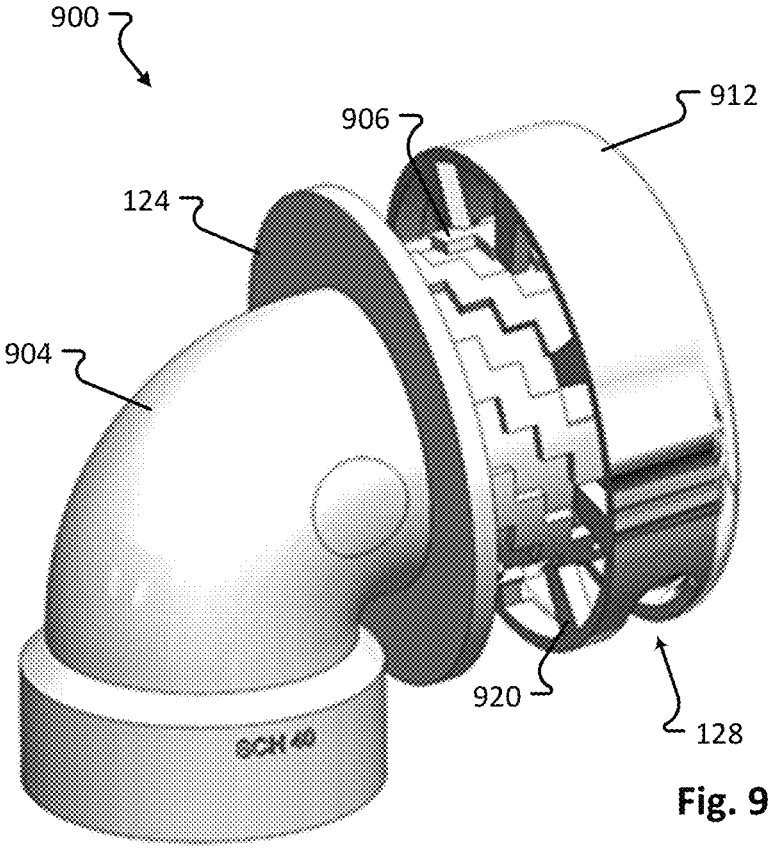
FIG. 9B is a perspective view of the embodiment of FIG. 9A.

Referring now to FIGS. 9A and 9B, an overflow cover interconnection system 900 comprises an overflow elbow 904 and an overflow cap 912. The overflow elbow 904 is provided with a flange 124. However, instead of a threaded upper portion, the upper portion 908 of the elbow 904 comprises a series of stepped tabs 906 that define a series of channels 910. The overflow cap 912 comprises a series of locking pins 920 extending inwardly from the inner circumference 624 of the overflow cap 912. The overflow cap 912 also comprises at least one aperture 128.

The upper portion 908 of the elbow 904 is inserted from the exterior side to the interior side of an opening in a bathtub wall 120. Here, the elbow 904 is secured by aligning the locking pins 920 with the channels 910 between the stepped tabs 906 on the upper portion 908 of the elbow 904, and then alternately pushing and rotating the overflow cap 912 until the overflow cap 912 cannot be pushed in (i.e., towards the bathtub wall 120) any farther because it contacts the bathtub wall 120. The system 900 advantageously may easily accommodate bathtub walls 120 of varying thickness, because the overflow cap 912 can lock into position at any step of the stepped tabs 906.

Figure 10A:
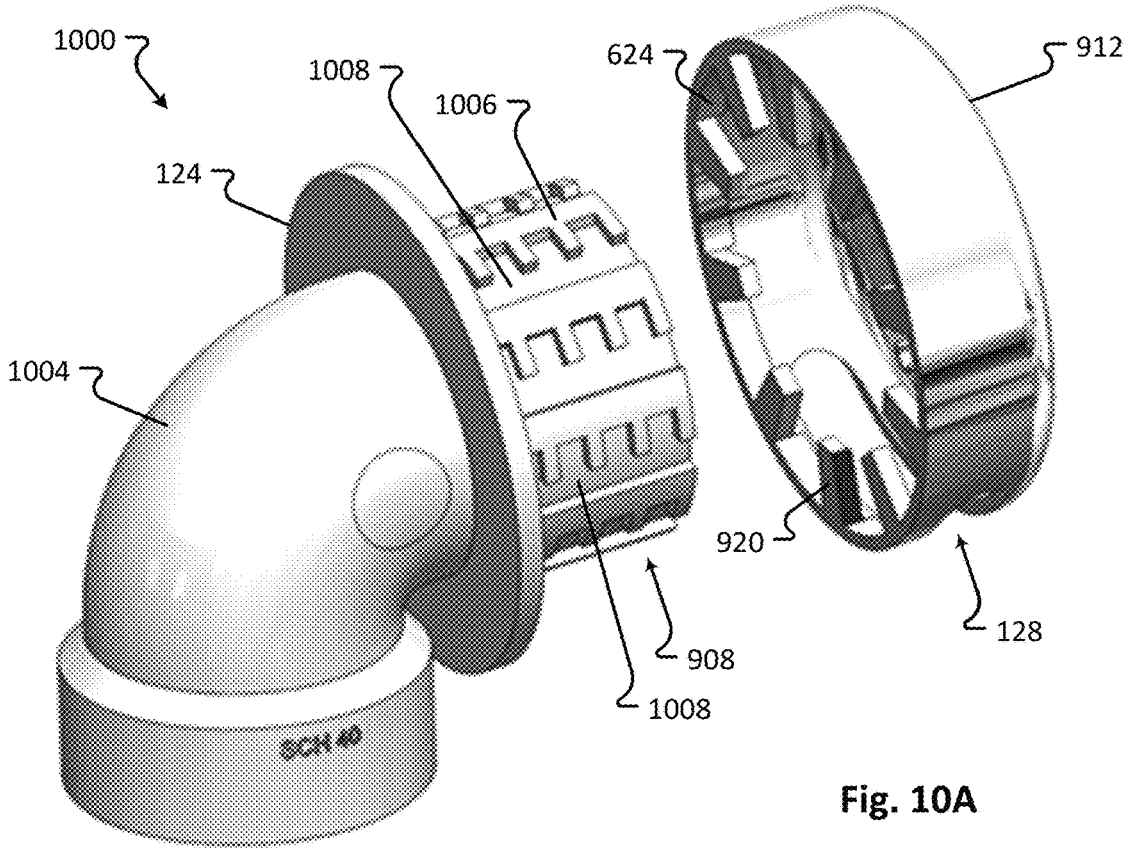
FIG. 10A is an exploded perspective view of an overflow cover interconnection system according to another embodiment of the present invention.
Figure 10B:
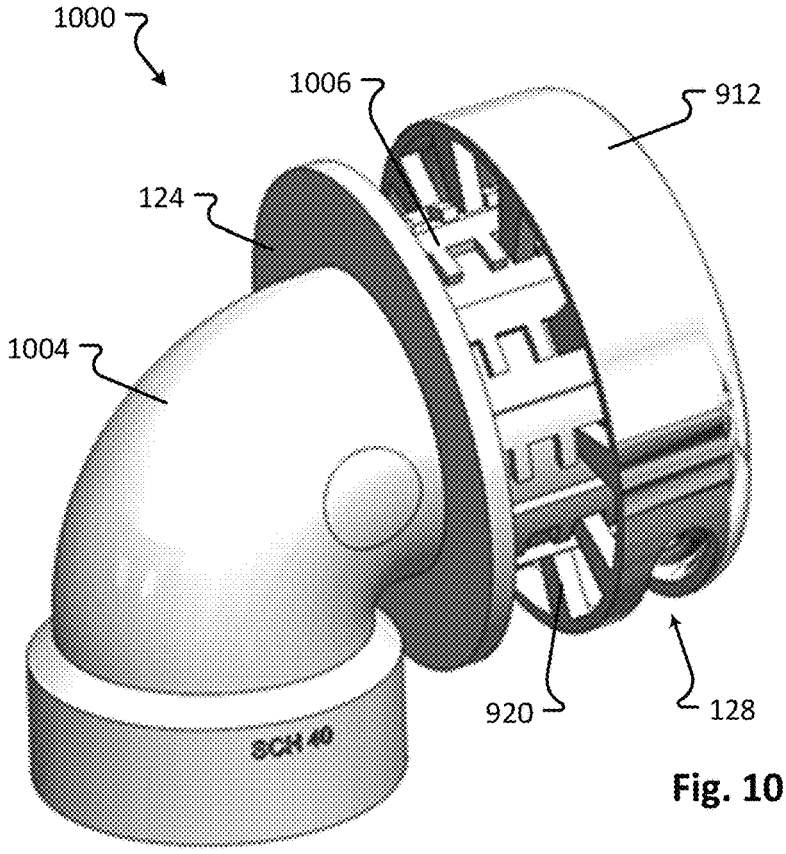
FIG. 10B is a perspective view of the embodiment of FIG. 10A.

Turning to FIGS. 10A and 10B, an overflow cover interconnection system 1000 that also uses a bayonet-style locking mechanism comprises an elbow 1004 and an overflow cap 912. The elbow 1004 employs a series of branched tree tabs 1006 arranged on the upper portion 908. Each branched tree tab 1006 comprises a main trunk that extends axially from the front of the upper portion 908 to the flange 124, and a plurality of evenly spaced branches extending circumferentially to one side of the main trunk of the tree tab 1006. Once the upper portion 908 has been inserted through a bathtub wall 120, the overflow cap 912 may be rotated until the locking pins 920 are aligned with the channels 1008 between the tabs 1006, then pushed back until the overflow cap 912 abuts the bathtub wall 120. When the overflow cap 912 cannot be pushed backward toward the bathtub wall 120 any farther, the overflow cap 912 can be rotated, thus causing the extended locking pins 920 to rotate into a locked position, where each extended locking pin 920 is positioned in between two branches of a tree tab 1006 and abuts the trunk of the tree tab 1006.

Like the system 900, the system 1000 advantageously may easily accommodate bathtub walls 120 of varying thickness, because the overflow cap 912 can lock into position between any two adjacent branches of the tree tabs 1006. Additionally, although not illustrated in the figures, each branch of the branched tree tabs 1006 may comprise a locking edge 862 at the free end thereof and protruding in the axial direction. Such locking edges 862 would provide some resistance to the movement of the extending locking pins 920 into or out of the locked position relative to the branched tree tabs 1006.

One of ordinary skill in the art will appreciate the stepped surface of FIGS. 9A and 9B, and the tree tabs of FIGS. 10A and 10B may be incorporated onto a sleeve that engages the threads of an existing overflow pipe. In this example, an existing system can be updated with a newer model if needed. Alternatively, if a new tub is installed, and the threads of an existing overflow system do not extend sufficiently into the tub, a sleeve with the features described herein interconnected to the existing overflow pipe can be used to provide additional length.

Figure 11A:
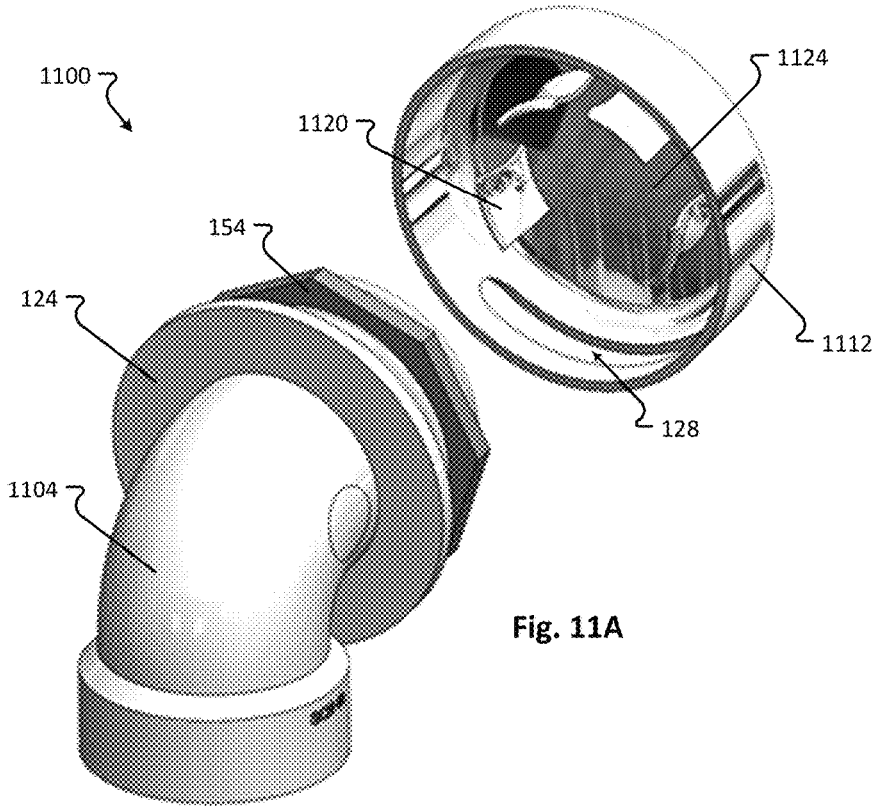
FIG. 11A is a partially exploded perspective view of an overflow cover interconnection system according to another embodiment of the present invention.
Figure 11B:
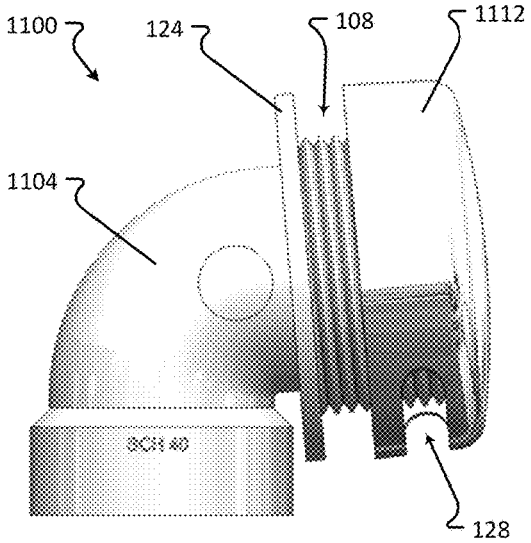
FIG. 11B is a side elevation view of the embodiment of FIG. 11A.
Figure 11C:
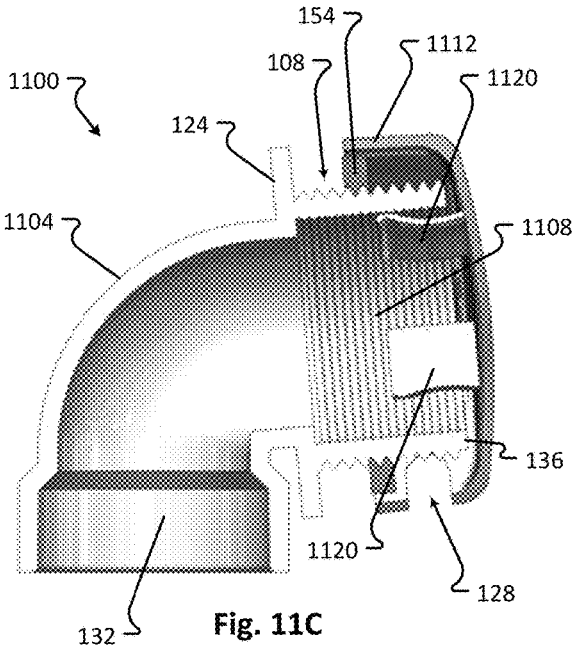
FIG. 11C is a cross-sectional elevation view of the embodiment of FIG. 11A.

FIGS. 11A, 11B, and 11C depict an overflow cover interconnection system 1100 that utilizes an overflow elbow 1104, a nut 154, and an overflow cap 1112. The overflow elbow 1104 comprises a threaded upper portion 108, a flange 124, and an inner passageway 132 through which fluid may flow out of a bathtub in which the overflow elbow 1104 is installed. Unlike the elbow 104, the elbow 1104 comprises inner ribs 1108 extending circumferentially along the inner surface of the threaded upper portion 108.

The overflow cap 1112 comprises a plurality of deflectable tabs 1120 extending rearwardly from the front inside face 1124 of the overflow cap 1112. The tabs 1120 are curved in the circumferential direction with a radius of curvature that matches or nearly matches the radius of curvature of the threaded upper portion 108. The tabs 1120 flare radially outwardly at the free end thereof before curving radially inwardly, although in other embodiments the tabs 1120 may be shaped differently. The tabs 1120 are configured to elastically deflect in the radial direction.

Once the elbow 1104 is installed in a bathtub wall 120, and has been secured in place with the nut 154, the overflow cap 1112 is pressed onto the end of the threaded upper portion 108. The inner deflectable tabs 1120 are forced to deflect inwardly slightly when they contact the front wall 136 of the threaded upper portion 108, after which the overflow cap 1112 can be pushed toward the bathtub wall 120 until the overflow cap 1112 covers the nut 154. The inner deflectable tabs 1120 engage the inner ribs 1108 of the threaded upper portion 108, thus holding the overflow cap 1112 in position. Any number of tabs 1120 may be provided on the overflow cap 1112.

The system 1100 beneficially uses a simple nut 154 to hold the elbow 1104 in position, which is beneficially hidden from view when the overflow cap 1112 is installed. The tabs 1120 of the overflow cap 1112 allow the overflow cap 1112 to be easily installed on the elbow 1104, with more contact area (and thus a more secure connection) than if the overflow cap 1112 were to simply engage the peaks of the nut 154, as in known overflow assemblies. Further, the geometry and thickness of the tabs 1120 may be modified (prior to manufacture) to vary the strength of the interconnection between the overflow cap 1112 and the elbow 1104, such that the system 1100 is adaptable for situations requiring a stronger fit (e.g. hotels, apartments, and other temporary living quarters) and those requiring a less robust connection (e.g. homes).

Figure 12A:
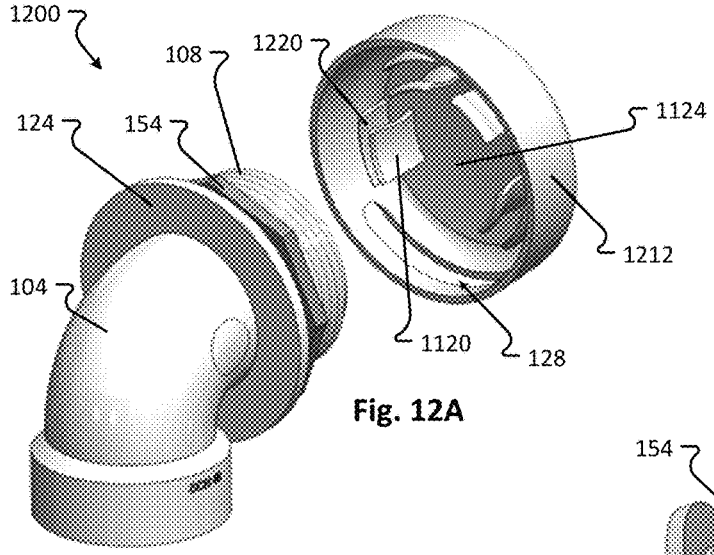
FIG. 12A is a partially exploded perspective view of an overflow cover interconnection system according to another embodiment of the present invention.
Figure 12B:
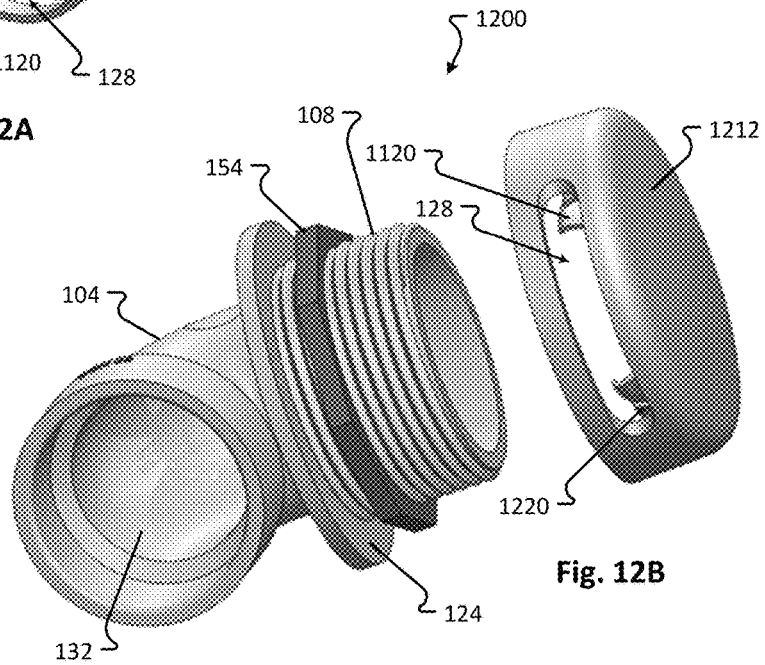
FIG. 12B is another partially exploded perspective view of the embodiment of FIG. 12A.
Figure 12C:
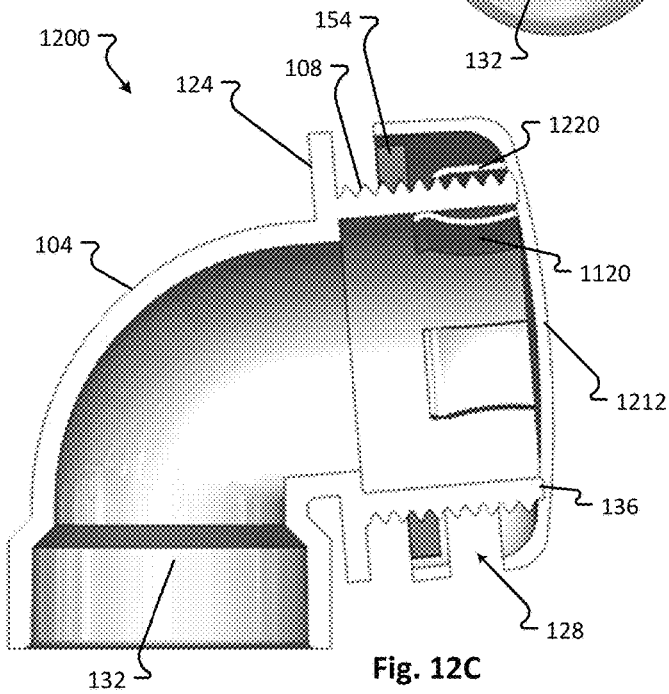
FIG. 12C is a cross-sectional elevation view of the embodiment of FIG. 12A.

FIGS. 12A, 12B, and 12C show an overflow cover interconnection system 1200 comprising a standard elbow 104, a standard nut 154, and an overflow cap 1212. The elbow 104 includes features described elsewhere herein, including a flange 124, a threaded upper portion 108, an inner passage 132, and a front wall 136. The nut 154 threads onto the threaded upper portion 108 to secure the elbow 104 into position in a bathtub wall 120. The overflow cap 1220 comprises at least one aperture 128 and a plurality of pairs of tabs extending rearwardly from the front inside face 1124 of the overflow cap 1212, each pair comprising an inner deflectable tab 1120 and an outer deflectable tab 1220.

After the elbow 104 has been installed in a bathtub wall 120 and secured in place with the nut 154, the overflow cap 1212 is pressed onto the end of the threaded upper portion 108. The deflectable tabs 1120 are forced to deflect inwardly slightly when they contact the front wall 136 of the threaded upper portion 108, and the outer deflectable tabs 1220 are forced to deflect outward slightly when they contact the front wall 136 and the threads of the threaded upper portion 108. The overflow cap 1212 is pushed toward the bathtub wall 120 until the overflow cap 1212 covers the nut 154. The inner deflectable tabs 1120 press against the inner wall of the threaded upper portion 108 and the outer deflectable tabs 1220 press against the threads of the threaded upper portion 108, thus holding the overflow cap 1212 in position. The geometry of the ends of the inner deflectable tabs 1120 and outer deflectable tabs 1220 may be configured to grip the inner wall or external threads, respectively, of the upper threaded portion 108. Although the overflow cap 1212 is shown with four pairs of tabs 1120 and 1220, any number of pairs of tabs 1120 and 1220 may be provided on the overflow cap 1112. Additionally, although the tabs 1120 and 1220 are shown in pairs on the overflow cap 1212, in some embodiments the tabs 1120 may not be aligned with the tabs 1220.

Although FIG. 12C depicts the overflow cap 1212 pressed against the front wall 136 of the upper threaded portion 108, in most installations the overflow cap 1212 would not be pressed against the front wall 136, so as to allow water to pass between the front wall 136 and the inside front face 1124 of the overflow cap 1212 and into the inner passageway 132 of the overflow elbow 104. In some embodiments, spacers may be provided on the inside front face 1124 of the overflow cap 1212 that are specifically intended to contact the front wall 136 of the elbow 1104, to prevent the overflow cap 1212 from being pressed against the front wall 136.

As with the system 1100, the system 1200 uses a simple nut 154 to hold the elbow 104 in position, which is beneficially hidden from view when the overflow cap 1212 is installed. The system 1200 also uses a standard overflow elbow 104. The use of a standard elbow 104 and standard nut 154 may help to reduce manufacturing and supply chain costs. The tabs 1120 and 1220 of the overflow cap 1212 advantageously allow the overflow cap 1212 to be easily installed on the elbow 104, with more contact area (and thus a more secure connection) than if the overflow cap 1212 were to simply engage the peaks of the nut 154, as in known overflow assemblies. Further, the geometry and thickness of the tabs 1120 and 1220 may be modified (prior to manufacture) to vary the strength of the interconnection between the overflow cap 1212 and the elbow 104, such that the system 1200 is adaptable for situations requiring a stronger fit (e.g. hotels, apartments, and other temporary living quarters) and those requiring a less robust connection (e.g. homes).

Figure 13A:
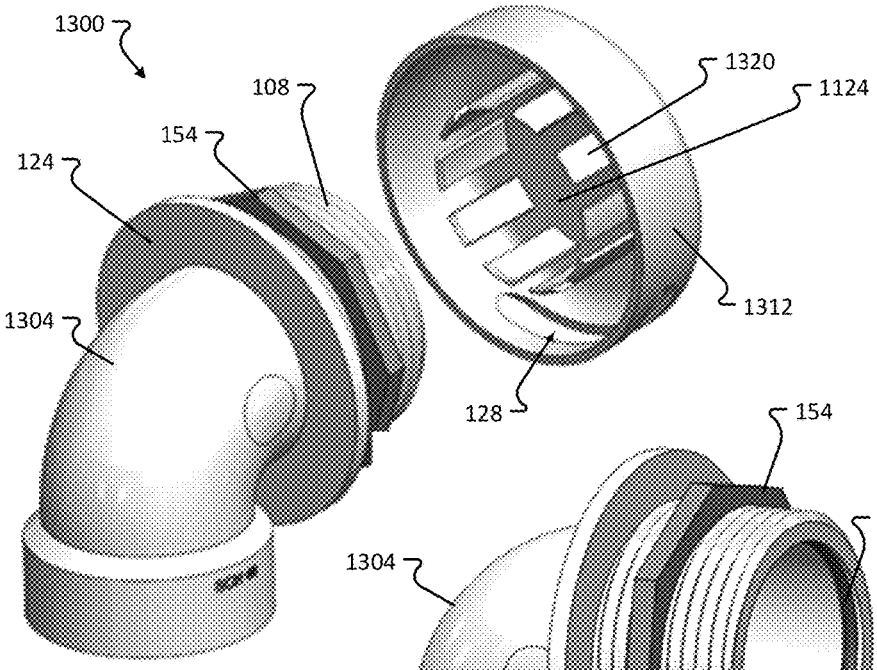
FIG. 13A is a partially exploded perspective view of an overflow cover interconnection system according to another embodiment of the present invention.
Figure 13B:
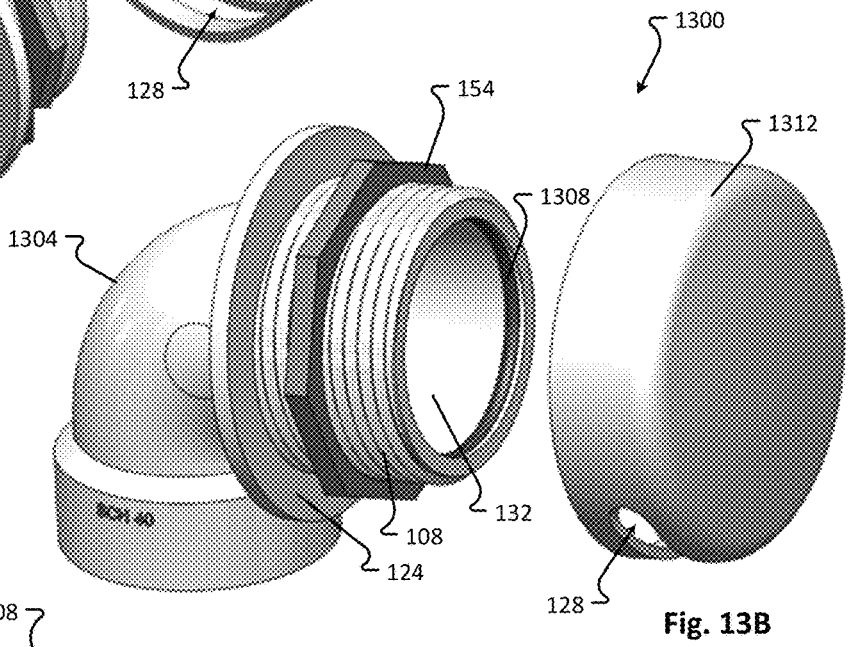
FIG. 13B is another partially exploded perspective view of the embodiment of FIG. 13A.
Figure 13C:
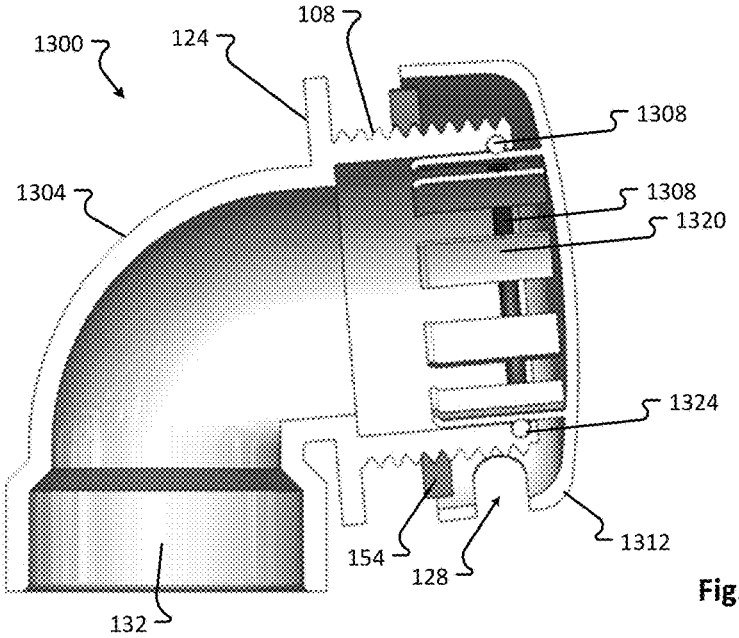
FIG. 13C is a cross-sectional elevation view of the embodiment of FIG. 13A.
Figure 15A:
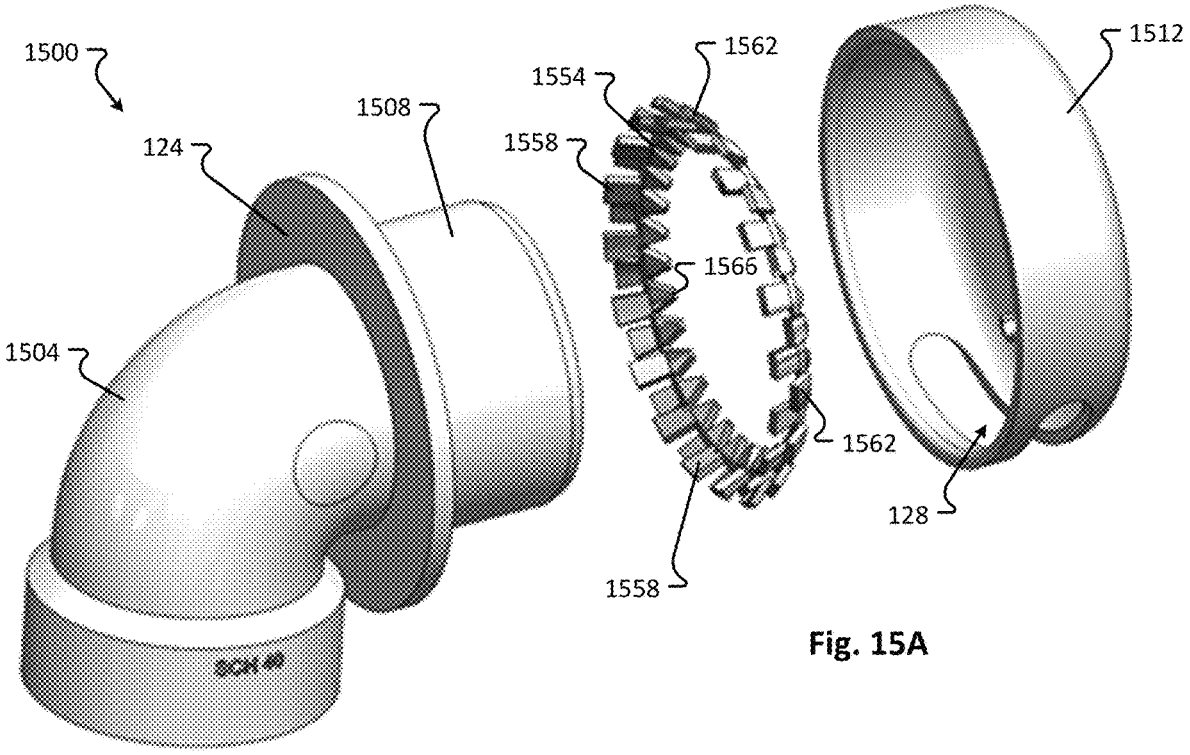
FIG. 15A is an exploded perspective view of an overflow cover interconnection system according to another embodiment of the present invention.
Figure 15B:
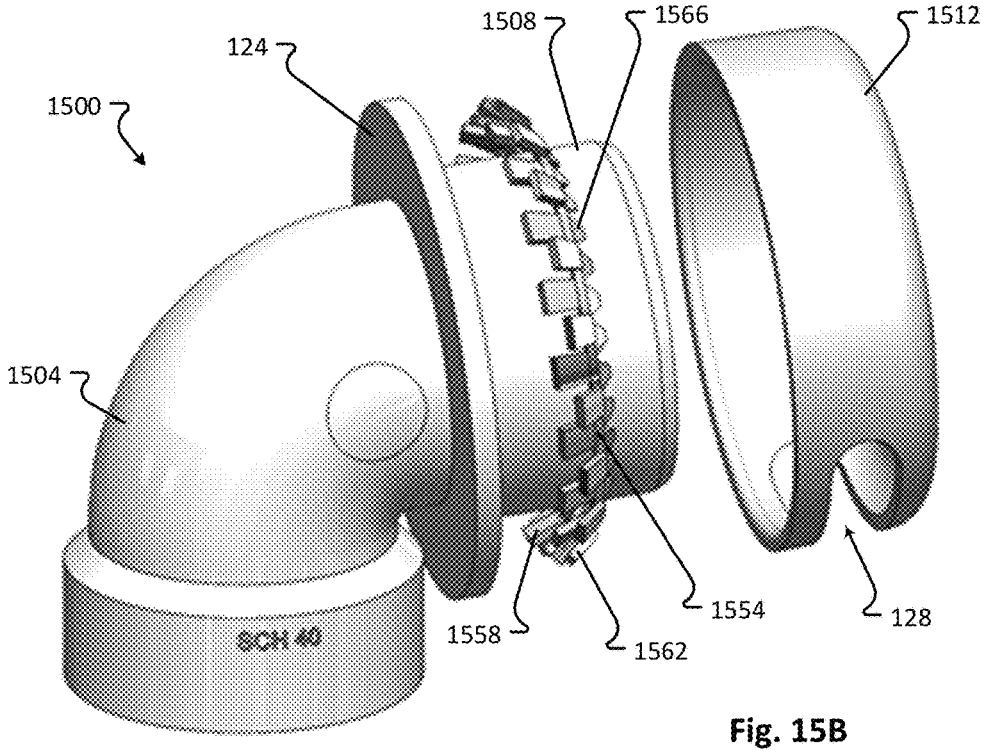
FIG. 15B is a partially exploded perspective view of the embodiment of FIG. 15A.
Figure 15C:
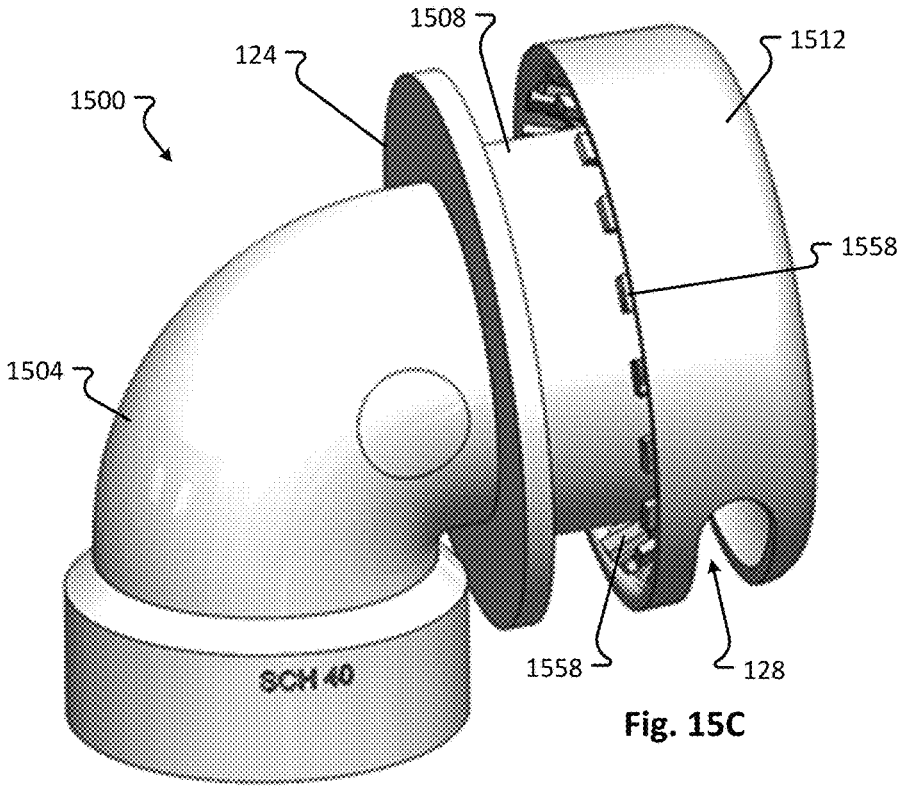
FIG. 15C is a perspective view of the embodiment of FIG. 15A.
Figure 15D:
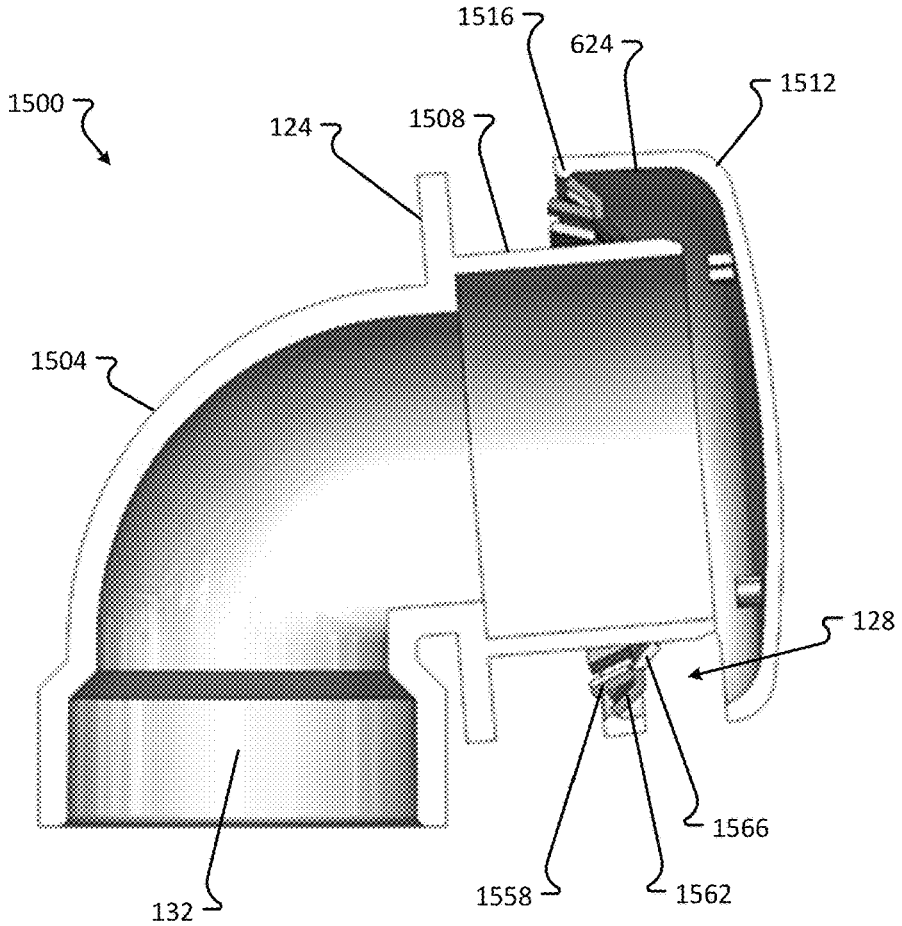
FIG. 15D is a cross-sectional elevation view of the embodiment of FIG. 15A.

FIGS. 13A, 13B, and 13C show an overflow cover interconnection system 1300, which uses a standard nut 154 together with an overflow elbow 1304 and an overflow cap 1312. The overflow elbow 1304 includes a flange 124, a threaded upper portion 108, and an inner passageway 132 through which water or other liquid may flow out of a bathtub and into an attached bathtub drain system. The overflow elbow 1304 is different than the standard elbow in that the overflow elbow 1304 includes a groove or channel 1324 around an inner circumference of the threaded upper portion 108, in which an O-ring 1308 (or any other type of gasket) is seated.

The overflow cap 1312 of the system 1300 comprises at least one aperture 128 and a plurality of fingers 1320 arranged in a circular formation and extending rearward from the front inside face 1124 of the overflow cap 1312. The overflow cap 1312 may have any number of fingers 1320, provided that enough fingers 1320 are available to hold the overflow cap 1312 in position when installed on the elbow 1304.

To install the system 1300, the upper threaded portion 108 of the overflow elbow 1304 is inserted through a hole in a bathtub wall 120, after which the nut 154 is threaded onto the threaded upper portion 108 until the nut abuts the tub wall 120. The overflow cap 1312 is then pressed onto the front of the upper threaded portion 108, with the fingers 1320 extending along the inner wall of the upper threaded portion 108 and contacting the O-ring 1308. The overflow cap 1312, once installed, covers the nut 154 to advantageously provide a more aesthetically pleasing finish, and is held in place by the friction fit between the fingers 1320 and the O-ring 1308.

The fingers 1320 may be provided with a slight inward curve at the free end thereof, to prevent the fingers 1320 from catching on the O-ring 1308 as the overflow cap 1312 is pressed into position.

As with the overflow caps in each of the systems 1100 and 1200, the overflow cap 1312 of the system 1300 may beneficially be rotated after installation into any desired rotational orientation (e.g. so that the aperture 128 faces downward). Additionally, as with the overflow caps in each of the systems 1100 and 1200, the overflow cap 1312 of the system 1300 may be installed so that the fingers 1320 extend a minimal distance into the upper threaded portion 108 (e.g. just past the O-ring 1308, if, for example, the elbow 1304 were installed on a thick tub wall 120), or a greater distance into the upper threaded portion 108 (e.g. well past the O-ring 1308, if, for example, the elbow 1304 were installed on a thin tub wall 120). In other words, the system 1300, like the systems 1100 and 1200, may be used with bathtubs having varying wall thickness without needing to make any changes to the configuration of any component thereof.

Referring now to FIGS. 14A, 14B, and 14C, an overflow cover interconnection system 1400 includes an elbow 1404, a nut 154, and an overflow cap 1412. The elbow 1404 comprises an upper threaded portion 108 with interior threads 1408 provided on an inner wall thereof. The elbow 1404 also comprises a flange 124 and an inner passageway 132, through which water or other liquid may flow as it exits a bathtub on which the overflow elbow 1404 is installed and passes into the bathtub drainage system.

The overflow cap 1412, like the overflow cap 1312, comprises a plurality of fingers, extending rearward from the front inside face 1124 of the overflow cap 1412 and arranged in a circular formation. Unlike the fingers 1320, however, the fingers 1420 comprises threads 1424 on a radially outward face thereof. The overflow cap 1412 also comprises at least one aperture 128. As with other overflow caps depicted and described herein, the overflow cap 1412 may comprise any number of apertures 128, and may also comprise any number of fingers 1420, provided that the fingers 1420 are sufficient in size and number to hold the overflow cap 1412 in position on the overflow elbow 1104.

Once the overflow elbow 1404 has been installed in a bathtub wall 120 and secured in place with the nut 154, in the same manner described with respect to the elbow 104, the overflow cap 1412 may be installed by threading the threads 1424 of the fingers 1420 into the inner threads 1408 of the upper threaded portion 108. The overflow cap 1412 may be threaded onto the threaded upper portion 108 as far as necessary until the overflow cap 1412 covers the nut 154, resulting in a more aesthetically pleasing finish than if the nut 154 were to remain visible to a user of the bathtub.

Here again, the overflow cap 1420 may be threaded onto the inner threads 1408 of the upper threaded portion 108 as much or as little as needed to cover the nut 154 and any exposed portion of the threaded upper portion 108. The overflow cap 1412 thus need not be altered for use with thick or thin bathtub walls 120.

FIGS. 15A, 15B, 15C, and 15D show an overflow cover interconnection system 1500 that comprises an elbow 1504, a metal ring 1554, and an overflow cap 1512. The elbow 1504 comprises a non-threaded upper portion 1508, a flange 124, and an inner passageway 132 adapted to channel liquid from one end of the overflow elbow 1504 to the other. The metal ring 1554 comprises standoff teeth 1558, outer teeth 1562, and gripping teeth 1566. The standoff teeth 1558, when the metal ring has been installed properly on the upper portion 1508 of the elbow 1504, point toward the bathtub wall 120/flange 124 and are bent at a lower angle than the outer teeth 1562. As a result, the standoff teeth 1558 extend farther rearward than the outer teeth 1562. Consequently, when the metal ring is pushed onto the upper portion 1508 of an elbow 1504 that has been installed in a bathtub wall 120, the standoff teeth 1558 will contact the tub wall 120 and ensure that the outer teeth 1562 remain available to secure the overflow cap 1512 into position.

The outer teeth 1562 are angled outward more than the standoff teeth 1558. These outer teeth 1562 are intended to catch the lip 1516 around the inner circumference of the overflow cap 1512 and to then hold the overflow cap 1512 in position. When the overflow cap 1512 is pushed over the metal ring 1554, the lip 1516 may first press against the forward-facing surface of the outer teeth 1562, causing the teeth 1562 to deflect inwardly enough to allow the lip 1516 to pass over the outer teeth 1562. The outer teeth 1562 then spring back into position, and the rearward-facing end surface of the outer teeth 1562 block the lip 1516 from moving forward, off of the metal ring 1554, unless sufficient force is applied to again deflect the outer teeth 1562 inward and out of the way of the lip 1516.

The metal ring 1554 also includes pointed gripping teeth 1566, which are configured to point radially inward and forward at an angle from the metal ring 1554. These gripping teeth 1566 allow the metal ring 1554 to be slid over the upper portion 1508 of the elbow 1504 to secure the elbow 1504 in position in a tub wall 120. However, attempts to slide the metal ring 1554 forward, off of the upper portion 1508, will cause the gripping teeth 1566 to dig into the outer surface of the upper portion 1508, thus preventing removal of the ring 1554 from the upper portion 1508. The metal ring 1554 thus provides a largely tamper-proof mechanism for securing the overflow elbow 1504 to a bathtub wall 120. Depending on the size of the lip 1516 of the overflow cap 1512, the metal ring 1554 may also provide a largely tamper-proof mechanism for securing the overflow cap 1512 in position over the upper portion 1508. A larger lip 1516 will require greater deflection of the outer teeth 1562 when installed over the metal ring 1554, but more importantly will present a greater obstacle to removal of the overflow cap 1512.

As will be evident from the foregoing description, the system 1500 may be used with bathtubs having walls 120 of varying thicknesses, as the metal ring 1554 need only be slid onto the upper portion 1508 enough to allow the gripping teeth 1566 to engage the upper portion 1508, but may be slid substantially farther onto the upper portion 1508. The system 1500 also allows the overflow cap 1512 to be rotated after installation, so that the aperture 128 can be positioned in a desired position, or so that some other desired rotational orientation of the overflow cap 1512 may be achieved.

Many variations of the system 1500 are possible. For example, the outer teeth 1562 could be interconnected to a nut such as the nut 154, rather than to the metal ring 1554. Alternatively, the metal ring 1554 could be provided with inner threads, rather than or in addition to the gripping teeth 1566.

Additionally, instead of outer teeth 1562 provided on the metal ring 1554, the overflow cap 1512 could be provided with teeth oriented similarly to the gripping teeth 1566, but extending from an internal circumference of the sidewall of the overflow cap 1512 (e.g. from the lip 1516, or instead of the lip 1516). Such teeth would allow the overflow cap 1512 to be slid onto the upper portion 1508, but would prevent removal of the overflow cap 1512 from the upper portion 1508 by digging into the surface of the upper portion 1508 when a force is applied to the overflow cap 1512 in the forward direction.

Further, the metal ring 1554 may be provided only with outer teeth 1562, and without standoff teeth 1558 and/or gripping teeth 1566. The outer teeth 1562 could be positioned to flex just enough to allow the overflow cap 1512 to be installed over the outer teeth 1562, and may further be configured to provide some resistance to removal of the overflow cap 1512 but not so much that removal of the overflow cap 1512 is impossible.

Still further, the outer teeth 1562 may be incorporated into the upper portion 1508 of the elbow 1504, rather than provided on a separate metal ring 1554. One or more of the ring 1554, the standoff teeth 1558, the outer teeth 1562, and the gripping teeth 1566 may be made from plastic or some other material instead of from metal. Any of the standoff teeth 1558, the outer teeth 1562, and the gripping teeth 1566 may be provided at only specific locations (including as few as two locations) around a circumference of the metal ring 1554, rather than around the entire circumference of the metal ring 1554.

Figure 16A:
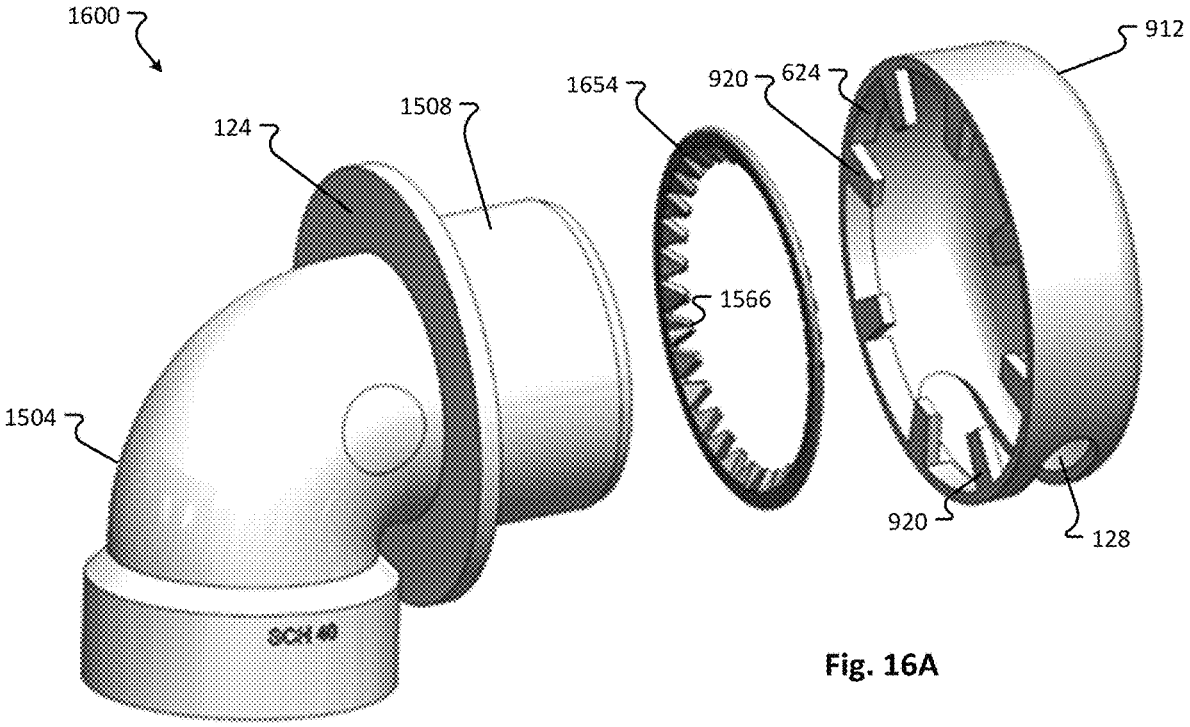
FIG. 16A is an exploded perspective view of an overflow cover interconnection system according to another embodiment of the present invention.
Figure 16B:
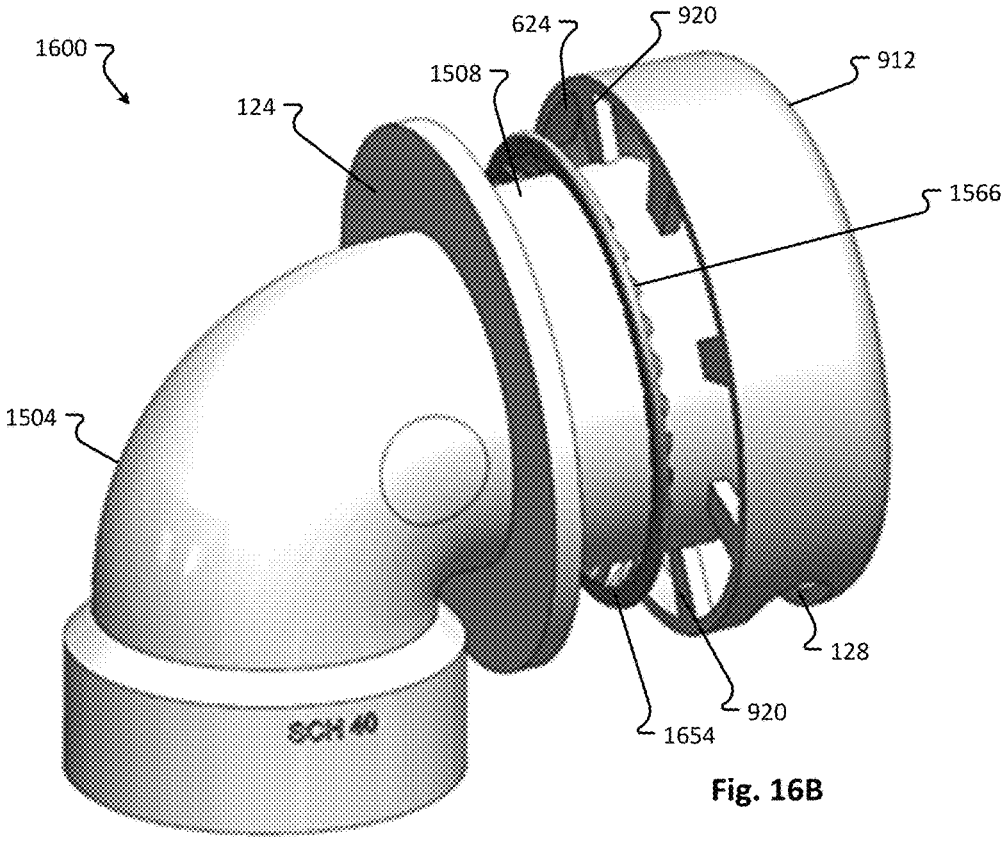
FIG. 16B is a perspective view of the embodiment of FIG. 15A.
Figure 16C:
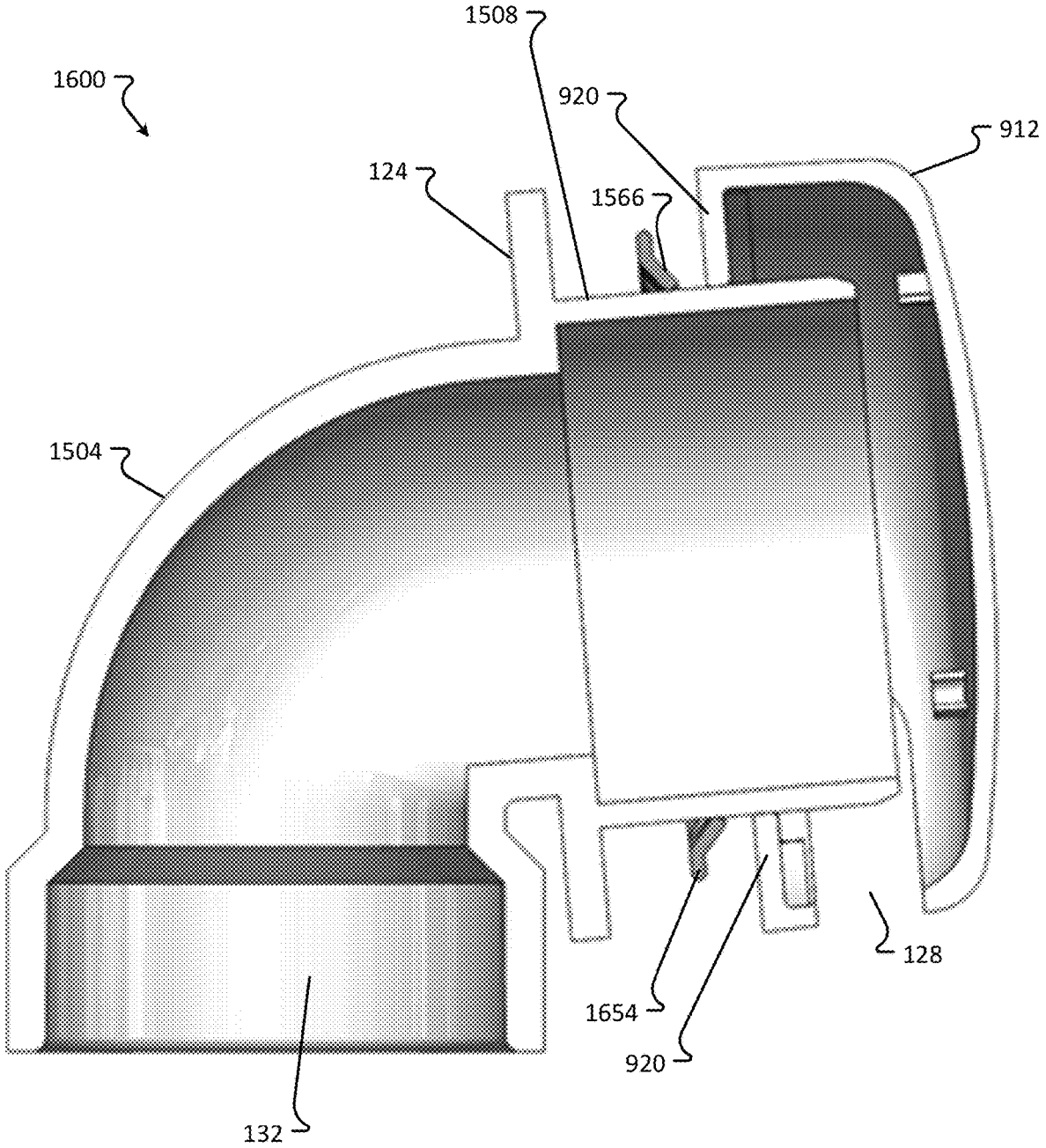
FIG. 16C is a cross-sectional elevation view of the embodiment of FIG. 15A.

FIGS. 16A, 16B, and 16C show an overflow cover interconnection system 1600 that includes an elbow 1504, a metal ring 1564, and an overflow cap 912. The elbow 1504, as described above, has a non-threaded upper portion 1508, a flange 124, and an inner passageway 132 for the transport of liquid. The overflow cap 912, as also described above, includes a plurality of extended locking pins 920 extending radially inward from an internal circumference 624 of the overflow cap 912, and also includes at least one aperture 128. The metal ring 1654 includes only gripping teeth 1566, which have the same structure and function as described above.

In the system 1600, the metal ring 1654 is intended only to hold the elbow 1504 in position in a bathtub wall 120, and does not interact with the overflow cap 912. The extended locking pins 920 of the overflow cap 912 are sized so that the radially inward ends of the extended locking pins 920 contact the outer surface of the upper portion 1508, such that the overflow cap 912 remains in position due to a friction fit between the extending locking pins 920 and the upper portion 1508. The overflow cap 912 may be provided with any number of extended locking pins 920 suitable to hold the overflow cap 912 in position on the overflow elbow 1504, which may be as few as three, but may also be more than the eight depicted extended locking pins 920. The overflow cap 912 may beneficially be installed on the upper portion 1508 in any rotational orientation.

In some embodiments, the extended locking pins 920 may be inset from the rear edge of the overflow cap 912, so that the side surface of the overflow cap 912 can extend over the metal ring 1654 to provide a more aesthetically pleasing appearance when the system 1600 is fully installed. Also in some embodiments, the overflow cap 912 may be provided with a portion that is inserted into the upper portion 1508 of the overflow elbow 1504 to help secure the overflow cap 912 in position. In other embodiments, the overflow cap 912 may not include any extended locking pins 920, but may instead be provided only with one or more fingers, tabs, cylindrical walls, or other structure(s) adapted to fit into the upper portion 1508 of the elbow 1504.

Figure 17A:
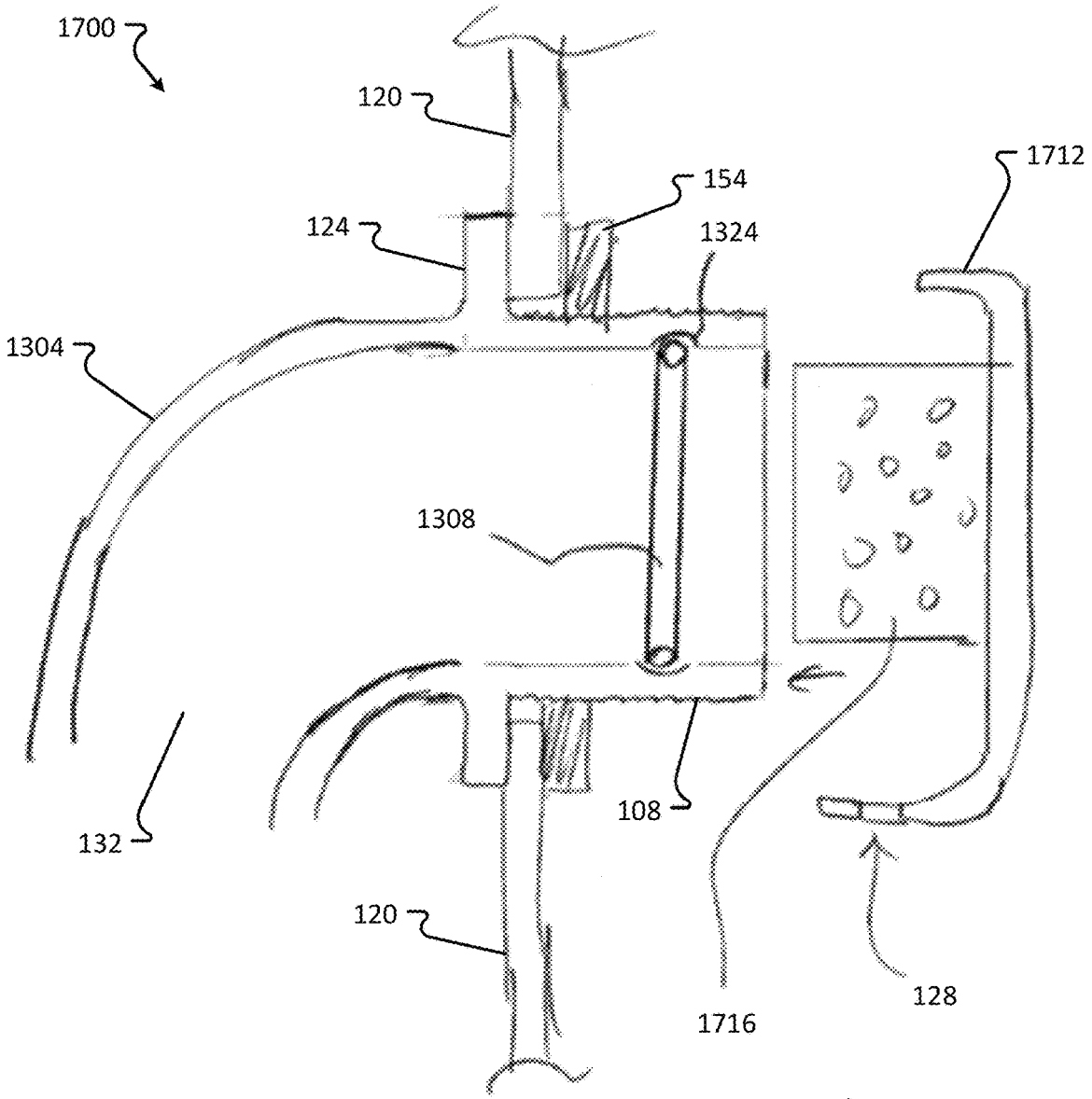
FIG. 17A is a cross-sectional elevation view of an overflow cover interconnection system according to a seventeenth embodiment of the present invention.

FIG. 17A depicts an overflow cover interconnection system 1700, which utilizes an overflow elbow 1304, a nut 154, and an overflow cap 1712. The overflow elbow 1304, as described above, includes a flange 124, an upper threaded portion 108, an inner passageway 132, an internal, circumferential groove or channel 1324, and an O-ring 1308 or other gasket seated in the groove 1324. The nut 154 secures the elbow 1304 to a bathtub wall 120 in the same manner described with respect to various of the embodiments of the present invention. The overflow cap 1712 includes a cylindrical wall 1716, which is provided with a plurality of openings or apertures to allow liquid or other fluid to pass therethrough. The cylindrical wall 1716 has an outer diameter that is slightly smaller than the inner diameter of the upper portion 108, such that the cylindrical wall 1716 can be inserted into the upper portion 108 and held in place by a friction fit with the O-ring 1308. Here again, the system 1700 is adaptable to bathtub walls 120 having varying thicknesses, as the cylindrical wall 1716 need only engage the O-ring 1308 to ensure the overflow cap 1712 stays in position. Also, the overflow cap 1712 may be installed on the upper portion 108 in any rotational orientation. In some embodiments, the overflow cap 1712 may have an overall diameter large enough to extend over the nut 154 when the cap 1712 has been installed on the upper portion 108, which may improve the aesthetics of the installed system 1700.

Figure 17B:
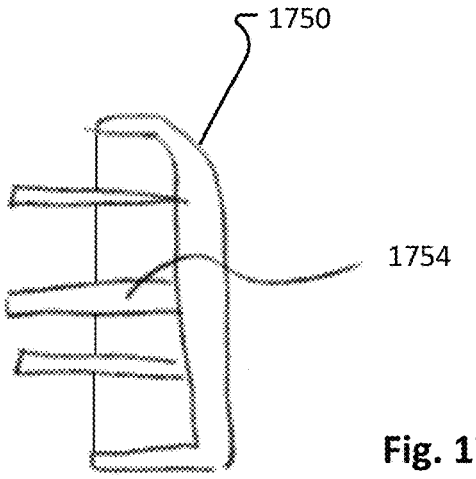
FIG. 17B is a cross-sectional elevation view of an alternative overflow cap for use in the embodiment of FIG. 17A.

FIG. 17B shows an alternative overflow cap 1750 for use in the system 1700 instead of the overflow cap 1712. The alternative overflow cap 1750 utilizes a plurality of fingers 1754 instead of the cylindrical wall 1716, but otherwise operates in the same manner and with the same benefits as the overflow cap 1712.

Figure 18A:
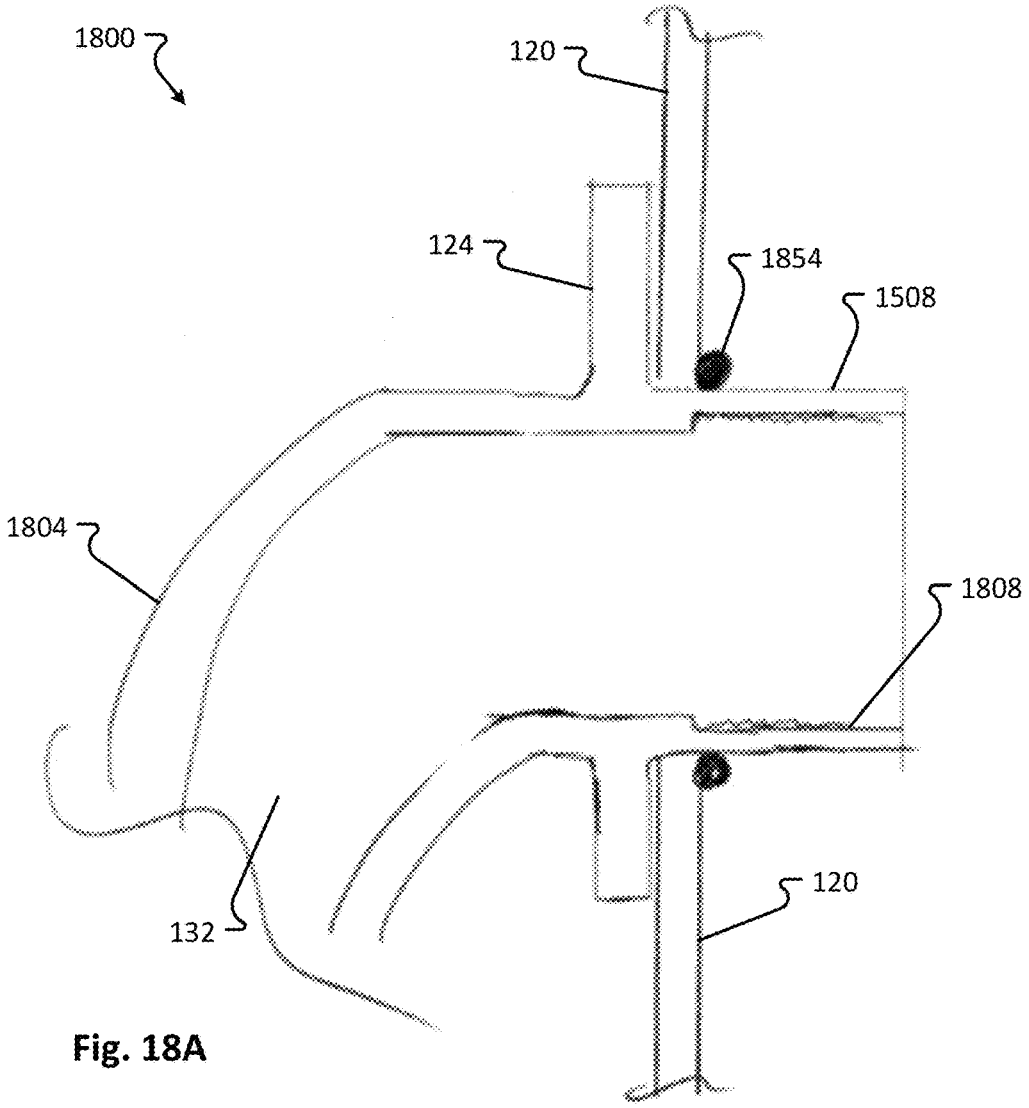
FIG. 18A is a cross-sectional elevation view of an overflow cover interconnection system according to another embodiment of the present invention.
Figure 18B:
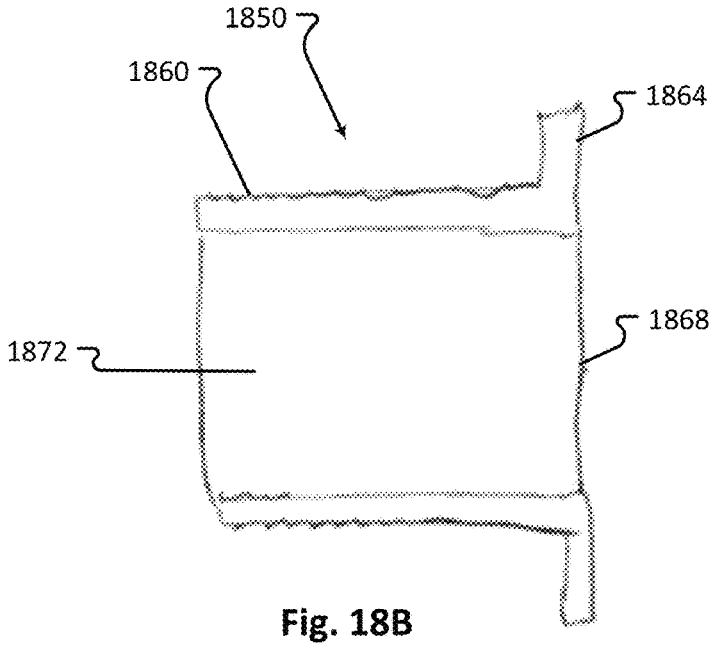
FIG. 18B is a cross-sectional elevation view of an insert for use in the embodiment of FIG. 18A.

FIGS. 18A and 18B show an overflow cover interconnection system 1800 that includes an overflow elbow 1804, an O-ring 1854, and an insert 1850. The elbow 1804 includes an upper portion 1508 with internal threads 1808, a flange 124, and an inner passageway 132 for transporting liquids. The elbow 1804 may be installed in a bathtub wall 120 in the normal fashion, after which the O-ring 1854 is slid over the upper portion 1508 until it contacts the wall 120, so as to hold the elbow 1804 in position. The insert 1850 includes outer threads 1860 adapted to engage the inner threads 1808 of the elbow 1804; a flange 1864 that receives an overflow cap (not shown) with a snap fit, a press fit, or any other interconnection method disclosed herein; and a removable skin or membrane 1868 for blocking the inner passageways 1872 and 132 after installation of the system 1800 and during testing thereof. The insert 1850 may thus be threaded into the upper portion 1508 of the elbow 1804, and once testing is complete and the skin or membrane 1868 has been removed or at least perforated or otherwise opened, an overflow cap may be installed over the insert flange 1864 to complete installation of the system 1800.

The components of the various overflow cover interconnection systems described herein may be made, for example, of plastic (including, but not limited to, PVC), metal (including, but not limited to, brass, bronze, copper, or stainless steel), ceramic, or other suitable materials, or any combination of the foregoing. Additionally, one or more components of the overflow cover interconnection systems described herein may be provided with a finish that differs from the material of which the component is primarily made. Possible finishes include but are not limited to aged pewter, brushed bronze, brushed nickel, oil-rubbed bronze, polished brass, and wrought iron.

Additionally, as will be evident from the foregoing disclosure, many of the features described herein with respect to a particular overflow cover interconnection system may be used or included in a different overflow cover interconnection system described herein. As just one example, a membrane or skin such as the membrane or skin 1868 described in connection with the system 1800 may be attached or connected to the front face 136 of the elbow 104, or otherwise applied to the front of the upper portions of the various elbows described herein. Further still, the various benefits and advantages described in connection with one of the various overflow cover interconnection systems described herein may also be realized or provided by another of the various overflow cover interconnection systems described herein, even if not specifically mentioned or described in connection with the other of the various overflow cover interconnection systems.

References in the foregoing description to "one embodiment," "an embodiment," "an example embodiment," "some embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in conjunction with one embodiment, it is submitted that the description of such feature, structure, or characteristic may apply to any other embodiment unless so stated and/or except as will be readily apparent to one skilled in the art from the description.

While various embodiments of the present invention have been described in detail, it is apparent that modifications and alterations of those embodiments will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Also, the foregoing description utilizes examples to better illustrate one or more aspects of the disclosed embodiments, but such examples—the use of which may be indicated by language such as "for example," "e.g.," "such as," and "by way of example"—are not intended to be limiting.

What is claimed is:

1. An overflow cover system comprising:

an overflow elbow comprising an interior passageway and a substantially cylindrical upper portion defining an inlet to the interior passageway, wherein the inlet comprises an inner surface, and wherein the inlet is free from cross-beams or protrusions that accommodate screw holes; and an overflow cap comprising a front wall, a substantially cylindrical sidewall, one or more tabs extending into a volume defined by both the sidewall and the front wall, and a rear opening defined by the sidewall and adapted to receive at least a section of the upper portion, wherein when the overflow elbow is received within the overflow cap, at least a portion of the one or more tabs deflect inwardly and in a direction away from the sidewall to engage with at least a portion of the inner surface of the upper portion.

2. The overflow cover system of claim 1, wherein at least a portion of the one or more tabs deflecting inwardly comprises compression of the at least a portion of the one or more tabs to engage with the at least a portion of the inner surface of the upper portion.

3. An overflow cover system comprising:

an overflow elbow comprising a substantially cylindrical portion, the substantially cylindrical portion having a wall and an inner surface extending from the wall, wherein the inner surface at least partially defines an internal passageway extending through the overflow elbow;

an overflow cap comprising a front wall having an inside face and a substantially cylindrical sidewall extending from the inside face; and a connection member extending from the inside face of the front wall and spaced apart from the sidewall, wherein when the overflow cap is coupled to the overflow elbow, the connection member extends past the wall of the substantially cylindrical portion and directly engages with the inner surface of the substantially cylindrical portion.

4. The overflow cover system of claim 3, further comprising a receiving member formed on the inner surface of the overflow elbow, wherein when the overflow cap is coupled to the overflow elbow, the connection member engages with the receiving member.

5. The overflow cover system of claim 4, wherein when the connection member engages with the receiving member, the overflow cap is rotatable relative to the overflow elbow.

6. The overflow cover system of claim 3, wherein at least one aperture is defined within the overflow cap such that when the overflow cap is coupled to the overflow elbow fluid is flowable through the overflow cap and into the internal passageway.

7. The overflow cover system of claim 6, wherein the at least one aperture is defined at least partially within the sidewall.

8. The overflow cover system of claim 3, wherein the substantially cylindrical portion comprises a threaded outer surface, and the system further comprises a nut having internal threads, wherein when the nut is coupled to the overflow elbow, the nut threadingly engages with the substantially cylindrical portion.

9. The overflow cover system of claim 8, wherein the nut comprises an outer edge having alternating flats and peaks.

10. The overflow cover system of claim 3, further comprising an O-ring disposed between the connection member and the overflow elbow, when the overflow cap is coupled to the overflow elbow.

11. The overflow cover system of claim 10, wherein the O-ring is coupled to the inner surface of the overflow elbow.

12. The overflow cover system of claim 3, wherein the connection member comprises a cylindrical wall.

13. The overflow cover system of claim 12, wherein the cylindrical wall comprises one or more openings.

14. The overflow cover system of claim 3, further comprising an annular washer.

15. An overflow cover system comprising:

an overflow elbow comprising a flange and a substantially cylindrical portion extending from the flange, wherein the substantially cylindrical portion comprises an inlet and an inner surface extending from the inlet to at least the flange, wherein the inner surface has a first diameter, and wherein the inner surface at least partially defines an internal passageway extending through the overflow elbow; and an overflow cap comprising a front wall, a substantially cylindrical outer sidewall extending from an edge of the front wall, and one or more inner sidewalls extending from the front wall and offset from the outer sidewall, wherein the one or more inner sidewalls are circumferentially spaced on the front wall, wherein the spacing defines a second diameter, wherein the second diameter is smaller than the first diameter so that the one or more inner sidewalls can fit within the substantially cylindrical portion, and wherein when the overflow cap is coupled to the overflow elbow, the one or more inner sidewalls extend at least partially within the internal passageway and at least a portion of the one or more inner sidewalls directly engage with at least a portion of the inner surface of the substantially cylindrical portion.

16. The overflow cover system of claim 15, wherein at least one inner rib is defined on the inner surface of the overflow elbow, wherein when the overflow cap is coupled to the overflow elbow, at least a portion of the one or more inner sidewalls engage with at least a portion of the at least one inner rib.

17. The overflow cover system of claim 16, wherein the at least one inner rib extends substantially circumferentially along the inner surface of the overflow elbow.

18. The overflow cover system of claim 16, wherein the at least one inner rib is defined within the inner surface.

19. The overflow cover system of claim 15, wherein the one or more inner sidewalls are deflectable.

* * * * *